US005692385A

United States Patent [19]

Hollenbeck et al.

[11] Patent Number: 5,692,385

[45] Date of Patent: Dec. 2, 1997

[54] SYSTEM AND METHOD INITIATING DEFROST IN RESPONSE TO SPEED OR TORQUE OF EVAPORATOR MOTOR

[75] Inventors: Robert K. Hollenbeck; Roger C. Becerra; Brian L. Beifus, all of Fort Wayne, Ind.; Richard S. Tatman, Tyler, Tex.; William C. Hittie, Jr., Fort Wayne, Ind.

[73] Assignee: General Electric Company, Fort Wayne, Ind.

[21] Appl. No.: 592,733

[22] Filed: Jan. 26, 1996

[51] Int. Cl.[6] ..... F25B 47/02

[52] U.S. Cl. ..... 62/154; 62/140

[58] Field of Search ..... 62/128, 140, 151, 62/152, 154, 155, 156, 234

[56] References Cited

U.S. PATENT DOCUMENTS

| | | | |
|---|---|---|---|
| 4,123,792 | 10/1978 | Gephart et al. | 361/30 |
| 4,206,612 | 6/1980 | Gardner | 62/128 |
| 4,392,358 | 7/1983 | Hicks | 62/155 |
| 4,474,024 | 10/1984 | Eplett et al. | 62/140 |
| 4,638,233 | 1/1987 | Erdman | 318/644 |
| 4,653,285 | 3/1987 | Pohl | 62/126 |
| 4,662,184 | 5/1987 | Pohl et al. | 62/156 |
| 4,806,833 | 2/1989 | Young | 318/335 |
| 4,978,896 | 12/1990 | Shah | 318/254 |
| 5,019,757 | 5/1991 | Beifus | 318/254 |
| 5,075,608 | 12/1991 | Erdman et al. | 318/599 |
| 5,418,438 | 5/1995 | Hollenbeck | 318/432 |

*Primary Examiner*—Harry B. Tanner
*Attorney, Agent, or Firm*—Enrique J. Mora

[57] ABSTRACT

An apparatus for use with a refrigeration system including a compressor for compressing a working fluid evaporated in an evaporator and condensed in a condenser. A control circuit initiates operation of a refrigeration cycle and initiates a defrost cycle in response to a defrost enable signal. The apparatus drives an air moving assembly moving air over the evaporator. A motor including a rotatable assembly is in driving relation to the air moving assembly. An energizing circuit selectively energizes the motor in response to the control circuit. A sensing circuit generates a speed/torque signal representative of a speed or a torque of the motor. A defrost initiating circuit generates the defrost enable signal when the speed/torque signal indicates that the speed is greater than a predetermined speed or the torque is greater than a predetermined torque. As a result, the defrost cycle is initiated in response to degradation of the refrigeration cycle as indicated by frost or ice on the evaporator which reduces air flow through the evaporator and increases static pressure. Other demand defrost apparatus and methods of initiating and sensing defrost cycles are also disclosed.

35 Claims, 10 Drawing Sheets

SYSTEM AND METHOD INITIATING DEFROST IN RESPONSE TO SPEED OR TORQUE OF EVAPORATOR MOTOR

BACKGROUND OF THE INVENTION

The invention generally relates to electronically controlled motors and, in particular, to evaporator motors and refrigeration systems employing such evaporator motors for initiating and/or sensing defrost in response to the speed, torque or air flow rate.

Many prior art refrigeration systems initiate defrost cycles based on regular intervals as defined by a timer. However, frost or ice tends to build up on the evaporator coils at different rates in different environments depending on the time of year. Therefore, a system which defrosts at a regular interval may prematurely initiate defrost cycles at some intervals and belatedly initiate a defrost cycle at other times. This inability to time the defrost cycle to coincide with frost or ice build up on the evaporator coils results in inefficient operation of the refrigeration system.

Some systems have seasonal switches which allow the operator to change the period of time between defrost cycles. Since such systems can be switched on or off during different times of the year, they may increase the efficiency of the refrigeration system to some extent. However, such systems do not defrost as needed.

Other systems have tried using a frost or ice sensor on the evaporator coils to determine the defrost cycle. Such frost or ice sensors tend to be inaccurate and do not result in a significant improvement in efficiency and performance of the refrigeration system. Some systems have employed a single sensor head pump defrost control such as co-assigned U.S. Pat. No. 4,662,184, the entire disclosure of which is incorporated herein by reference. Other systems have employed an apparatus and method for detecting failure in a refrigerator defrost system such as disclosed in co-assigned U.S. Pat. No. 4,392,358, the entire disclosure of which is incorporated herein by reference.

Coassigned U.S. Pat. No. 4,653,285, the entire disclosure of which is incorporated herein by reference, describes self-calibrating control methods and systems for refrigeration systems. To determine whether a defrosting operation is needed immediately upon compressor startup, a compressor loading interval of 10 minutes is established. After the interval has elapsed, the compressor loading is compared to a normal load threshold ratio established as 0.95 times the reference ratio to determine whether compressor loading has built up to an expected normal load in the absence of defrosting. However, such a system looks at the compressor loading.

There is a need for a demand defrost system which looks to the speed or torque of the evaporator fan or air flow rate over the coils. There is also a need for a demand defrost system which would initiate defrost cycles at points when the refrigeration performance decreases to an unacceptable level. There is also a need for a system which initiates a defrost cycle independent of the level of food preservation, compressor operation and refrigeration power usage so that such food preservation, compressor operation and refrigeration power usages can be maintained at an efficient and acceptable level.

SUMMARY OF THE INVENTION

It is an object of this invention to provide a system and method for initiating demand defrost in response to changes in the speed or torque of the evaporator motor which are caused by changes in the static pressure of the air moving over the evaporator coils.

It is another object of this invention to provide a demand defrost system in which the evaporator motor operates at a constant air flow rate or at a constant speed or torque over the evaporator coils to provide a high efficiency system.

It is another object of this invention to provide a demand defrost apparatus which can be used in both a commercial or consumer environment to efficiently operate the refrigeration system and minimize premature and belated defrost cycling.

It is an object of this invention to provide a constant air flow or constant speed evaporator motor that detects changes in the refrigeration system static pressure and reacts to changes in fan speed allowing for uniform air flow or speed within the system.

It is another object of this invention to provide a constant air flow or constant speed evaporator motor for refrigeration systems which maintains a more constant temperature in a refrigerated compartment thereby extending the shelf life of fresh and frozen foods and reducing the number of defrost cycles over time.

It is another object of this invention to provide a constant air flow or constant speed evaporator motor which operates at a higher efficiency than conventional motors so that its energy consumption is reduced and its cost of operation is reduced.

It is another object of this invention to provide a constant air flow or constant speed evaporator motor which uses less wattage to achieve superior air flow performance than a conventional motor so that it produces less heat meaning less work and wear for the compressor and even greater savings and improved temperature stability.

It is another object of this invention to provide an evaporator motor which senses a defrost cycle of an evaporator coil by monitoring the speed, torque or air flow of the motor.

It is another object of this invention to provide an evaporator motor which operates a higher speed after a defrost cycle to overblow the evaporator coils and provide a fast cool down of the refrigerator compartment.

The invention comprises an apparatus for use with a refrigeration system including a compressor for compressing a working fluid evaporated in an evaporator and condensed in a condenser, and a control circuit for initiating operation of a refrigeration cycle and for initiating a defrost cycle in response to a defrost enable signal. The apparatus drives an air moving assembly moving air over the evaporator. A motor including a rotatable assembly is in driving relation to the air moving assembly. An energizing circuit selectively energizes the motor in response to the control circuit. A sensing circuit generates a speed/torque signal representative of a speed or a torque of the motor. A defrost initiating circuit generating the defrost enable signal when the speed/torque signal indicates that the motor speed is greater than a maximum or reference speed or that the motor torque is greater than a maximum or reference torque whereby the defrost cycle is initiated in response to degradation of the refrigeration cycle as indicated by frost or ice on the evaporator which reduces air flow through the evaporator and increases static pressure of the air flow.

The invention also comprises an apparatus for use with a refrigeration system including a compartment to be refrigerated; a temperature sensor for sensing the temperature in the compartment; a compressor responsive to the temperature sensor for compressing a working fluid evaporated in an evaporator for cooling the compartment and condensed in a condenser remote from the compartment; and a defrosting circuit for defrosting the evaporator during a defrost cycle in response to a defrost enable signal. The apparatus drives an air moving assembly moving air over the evaporator. A motor including a rotatable assembly drives the air moving assembly. An energizing circuit selectively energizes the motor. A sensing circuit generates a speed/torque signal representative of a speed or a torque of the motor. A defrost initiating circuit generating the defrost enable signal when the speed/torque signal indicates that the motor speed is greater than a maximum or reference speed or that the motor torque is greater than a maximum or reference torque whereby the defrost cycle is initiated in response to degradation of the refrigeration cycle as indicated by frost or ice on the evaporator which reduces air flow through the evaporator and increases static pressure of the air flow.

The invention also comprises a method of operating a refrigeration system including a compressor for compressing a working fluid evaporated in an evaporator and condensed in a condenser. The method comprising the steps of:

driving an air moving assembly with a motor to move air over the evaporator to cool a compartment;

sensing a speed/torque of the motor; and initiating a defrost cycle when the motor speed is greater than a maximum or reference speed or when the motor torque is greater than a maximum or reference torque whereby the defrost cycle is initiated in response to degradation of the refrigeration cycle as indicated by frost or ice on the evaporator which reduces air flow through the evaporator and increase static pressure of the air flow.

The invention also comprises an apparatus for use with a refrigeration system including a compressor for compressing a working fluid evaporated in an evaporator and condensed in a condenser and a control circuit for initiating operation of a refrigeration cycle and for initiating a defrost cycle. The apparatus drives an air moving assembly moving air over the evaporator. A motor including a rotatable assembly drives the air moving assembly. An energizing circuit selectively energizes the motor in response to the control circuit. A sensing circuit generates a speed/torque signal representative of a speed or a torque of the motor. A defrost cycle sensing circuit generates a defrost cycle signal provided to the control circuit when the speed/torque signal indicates a change in the motor speed or torque representing an defrost cycle. The control circuit deenergizes the motor for a first period of time in response to the defrost cycle signal whereby the motor does not rotate the air moving assembly during the defrost cycle.

In another form, the invention comprises an apparatus for use with a refrigeration system including a compressor for compressing a working fluid evaporated in an evaporator and condensed in a condenser and a control circuit for initiating operation of a refrigeration cycle and for initiating a defrost cycle in response to a defrost enable signal. The apparatus drives an air moving assembly moving air over the evaporator. A motor includes a rotatable assembly in driving relation to the air moving assembly. An energizing circuit selectively energizes the motor in response to the control circuit. A sensing circuit generates a speed/torque signal representative of a speed or a torque of the motor. A defrost initiating circuit generates the defrost enable signal when the speed/torque signal indicates that the air flow rate is less than a minimum or reference air flow rate whereby the defrost cycle is initiated in response to degradation of the refrigeration cycle as indicated by frost or ice on the evaporator which reduces air flow through the evaporator and increases static pressure of the air flow.

Other objects and features will be in part apparent and in part pointed out hereinafter.

BRIEF DESCRIPTION OF THE DRAWINGS

Corresponding reference characters indicate corresponding parts throughout the drawings.

BRIEF DESCRIPTION OF THE APPENDIX

Appendix A illustrates software according to one preferred embodiment of the invention for implementing constant air flow control according to the invention.

DETAILED DESCRIPTION OF THE PREFERRED EMBODIMENTS

Figure 1:
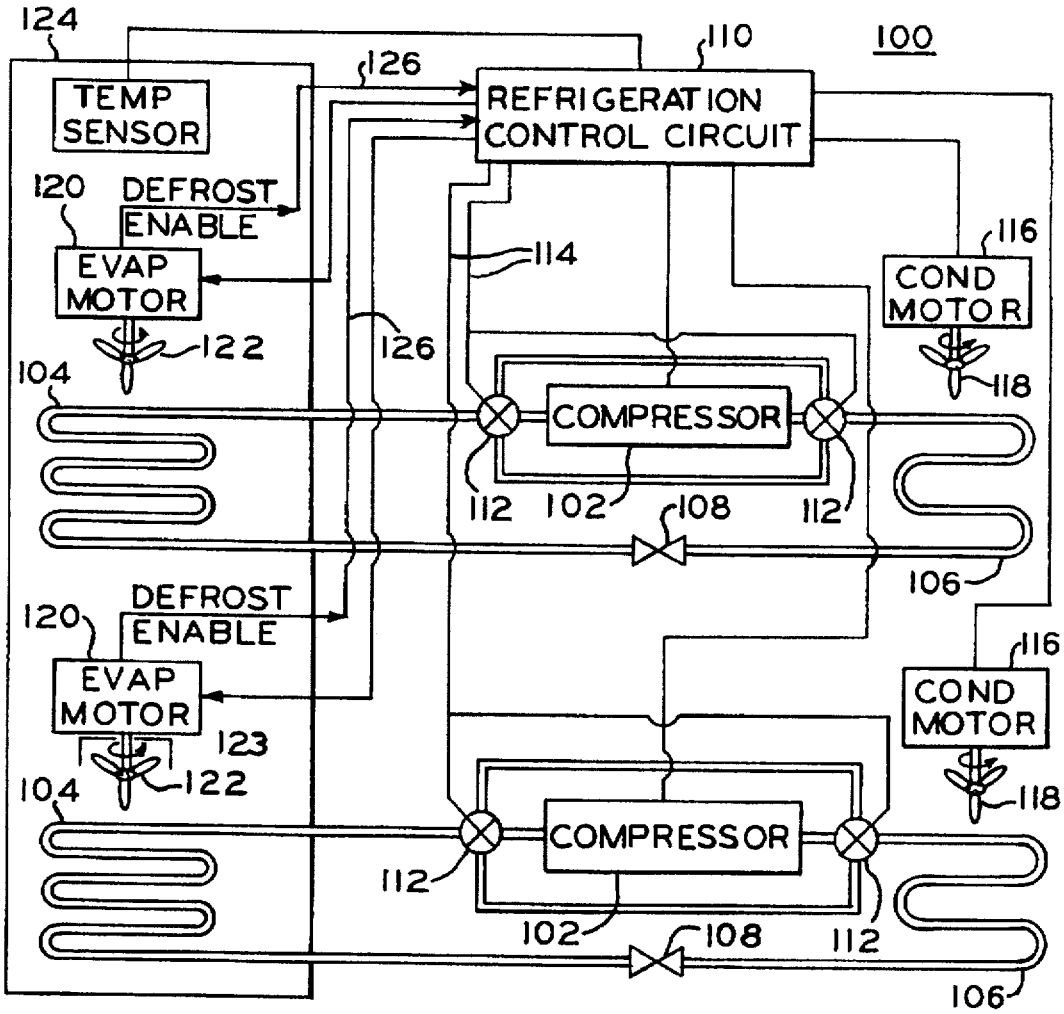
FIG. 1 is a schematic block diagram of a commercial refrigeration system having multiple compressors including a refrigeration control circuit for controlling the operation of evaporator fans according to the invention, the compressors and their defrost cycle.

FIG. 1 is a block diagram of a commercial refrigeration system 100 according to the invention. System 100 includes one or more compressors 102 which may be commercial compressor systems having multiple stage compressors, as is known in the art. Each compressor 102 compresses a working fluid to be evaporated in an evaporator 104 and to be condensed in a condenser 106. An expansion valve 108 as is known in the art separates the condenser and evaporator sections of the working fluid system. Although each compressor is illustrated as having only one evaporator, it is contemplated that multiple evaporators may be valved to a single compressor.

A refrigeration control circuit 110 initiates operation of a refrigeration cycle and initiates a defrost cycle. In particular, circuit 110 controls bypass valves 112 as is known in the art via lines 114 to allow hot gases to enter the evaporator 104 and initiate a defrost cycle to melt any frost or ice build up thereon.

Refrigeration control circuit 100 also controls condenser motors 116 which drive air moving assemblies 118 to circulate air over the condensers 106 and cool the condensers.

Refrigeration control circuit 110 may also energize one or more evaporator motors 120 which drive an air moving assembly 122 such as a fan blade assembly having a shroud 123 for circulating air over the coils and within the refrigerator compartment 124 to be cooled. Evaporator motors 120 may be any electronically controllable motor typically powered by an electronic commutating circuit. Such motors include single and variable speed motors, selectable speed motors having a plurality of finite, discrete speeds, and brushless dc motors, including electronically commutated motors, switched reluctance motors and induction motors. In addition, the motors may have a single split phase winding or a multi-phase winding. Motors 120 may also provide finite, discrete rotor speeds selected by an electrical switch or the like. In general, evaporator motors 120 include a rotatable assembly in driving relation to the air moving assembly 122 such as a propeller or squirrel cage. As will be described in greater detail below, evaporator motors 120 generate a defrost enable signal via line 126 to signal refrigeration control circuit 110 that a defrost cycle should be initiated. Circuit 110 may not immediately initiate a defrost cycle. For example, circuit 110 may be programmed to permit defrost cycles only during certain times of the day or night and, during certain high peak or high demand times, provide refrigeration rather than initiating a defrost cycle.

Although FIG. 1 illustrates a system with two compressors 102, two evaporator motors 120, and two condenser motors 116, it is contemplated that any number of each of these items may be part of the system controlled by refrigeration control circuit 110 according to the invention. If more than one evaporator motor 120 provides a defrost enable signal, circuit 110 may be programmed to initiate a defrost cycle under certain conditions. For example, circuit 110 may initiate a defrost cycle only when all evaporator motors 120 provide a defrost enable signal. Alternatively, circuit 110 may initiate a defrost cycle when a majority of the evaporator motors provide a defrost enable signal. Alternatively, circuit 110 may initiate a defrost cycle when any one, two or preset number of evaporator motors 120 provide a defrost enable signal or may initiate a partial defrost of the system or of one branch of the system.

Figure 2:
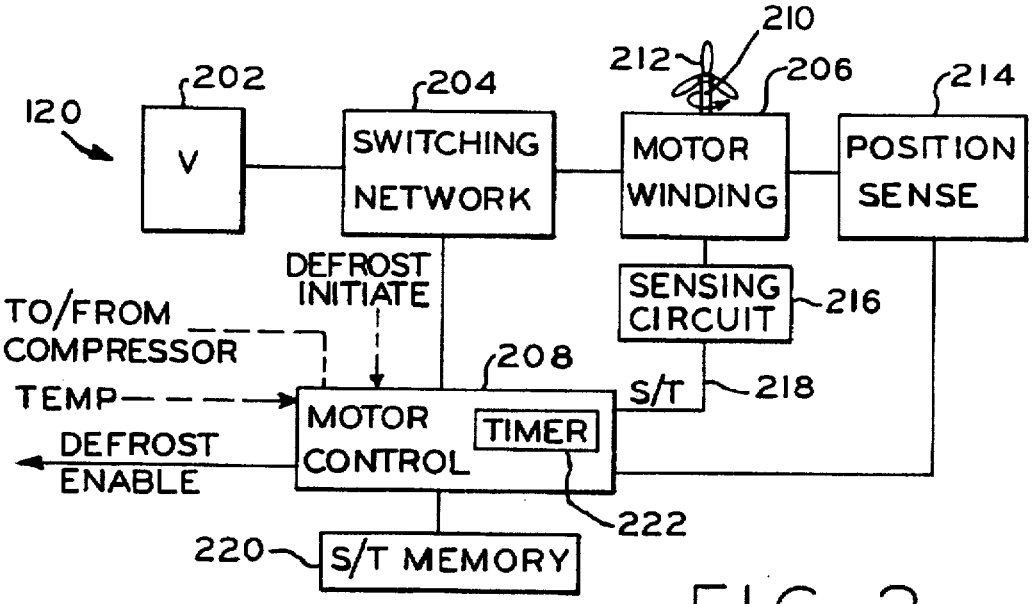
FIG. 2 is a block diagram of one preferred embodiment of the evaporator motor of the invention.

FIG. 2 is a block diagram of one preferred embodiment of the evaporator motor 120 according to the invention. A voltage source 202 supplies electrical power through a switching network 204 which is an energizing circuit for powering the motor windings 206. A motor control circuit 208 for generating the defrost enable signal controls the switching network 204 to commutate the motor windings 206 thereby driving a rotatable assembly 210 which in turn is in driving relation to a fan blade assembly 212. Motor control 208 (which may be integrated with circuit 110) may be responsive to some type of position sensing circuit 214 for determining the relative position of the rotatable assembly 210 and the stationary assembly of which the motor windings are part. For example, the position sensing circuit 214 may be a back emf sensing circuit, a hall device or other means for sensing the position of the rotatable assembly 212.

Motor 120 also includes a sensing circuit 216 for sensing the speed or torque of the motor. For example, sensing circuit 216 may be a voltage sensing circuit for sensing the speed of the rotatable assembly 210 or it may be a current sensing circuit for sensing the torque of rotatable assembly 210 or it may be both. Sensing circuit 216 provides a speed/torque signal to motor control 208 via line 218.

Motor 120 may also include a speed/torque (S/T) memory 220 which stores such information as a minimum or maximum speed, a minimum or maximum torque, a reference speed or a reference torque. Depending on the type of system and air moving apparatus, speed or torque may increase or decrease as ice builds on the evaporator and air flow is blocked. For example, if speed or torque increases in response to ice build up and a reduced air flow, a maximum or reference speed or torque may be used as the reference for determining when defrosting should be initiated. In this example, if speed/torque memory 220 stores a maximum or reference speed or torque, motor control 208 would generate a defrost enable signal when the speed/torque signal provided via line 218 indicates that the motor speed or torque has changed and is above the maximum or reference speed or torque, respectively. Alternatively, memory 220 may store a minimum or reference air flow rate so that motor control 208 would generate a defrost enable signal when the speed/torque signal indicates that the air flow rate is below the minimum or reference air flow rate.

Figure 3A:
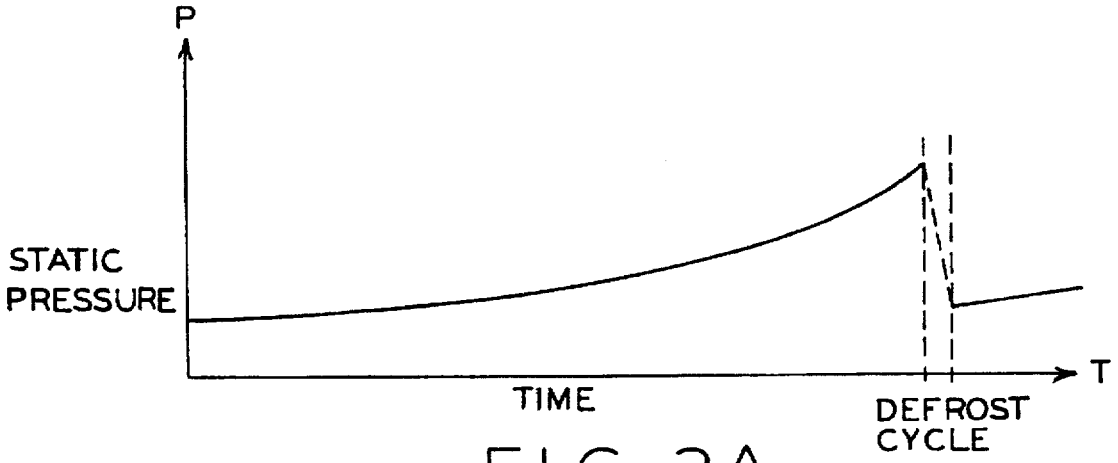
FIG. 3A is a graph illustrating the static pressure vs. time created by an evaporation fan of the invention as frost or ice builds on the evaporator coils between defrost cycles.
Figure 4:
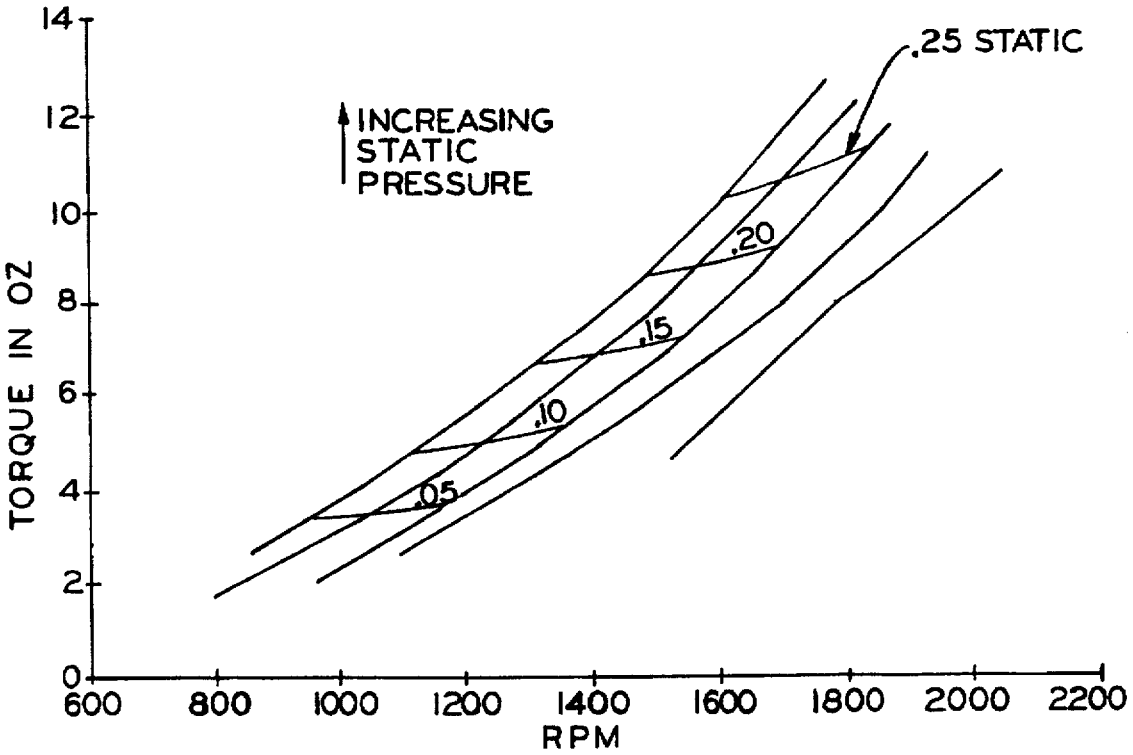
FIG. 4 is a graph of the constant CFM (cubic feet per minute) speed vs. torque curves of an evaporator motor of the invention at various static pressures.

As indicated in FIG. 3A, the static pressure of air flowing over the evaporator coils as moved by the air moving assembly 122 of the evaporator motor tends to increase between defrost cycles. This is because frost or ice tends to build up on the evaporator coils 104 restricting air flow over the coils and increasing the static pressure. During the defrost cycle, if the fan continues to run, the pressure drops as indicated by the dashed line. Immediately after a defrost cycle, as shown in FIG. 3A, the static pressure tends to be at a minimum or reference or low point and gradually increases thereafter. According to the invention, the defrost cycle is initiated in response to degradation of the refrigeration cycle as indicated by frost or ice on the evaporator coil which reduces air flow through the evaporator coil and increases static pressure. One way of detecting the increased static pressure is monitoring change in the speed or torque. Depending on the type of system and its air moving assembly, speed or torque will increase or decrease in response to ice build up on the evaporator and reduced air flow. For example, if the speed or torque increases with reduced air flow, one way of detecting increased static pressure is by setting a maximum or reference speed or a maximum or reference torque for the evaporator motor. In general, speed or torque tends to be proportional to static pressure so that as the static pressure changes by increasing or decreasing, the speed and torque will similarly change. FIG. 4 illustrates such speed/torque curves for constant air flow rates for a propeller fan which increases in speed and torque as ice builds up on the evaporator, i.e., each of the curves corresponds to a constant CFM. Each curve represents a higher constant air flow rate than the curve to its left.

Figure 3B:
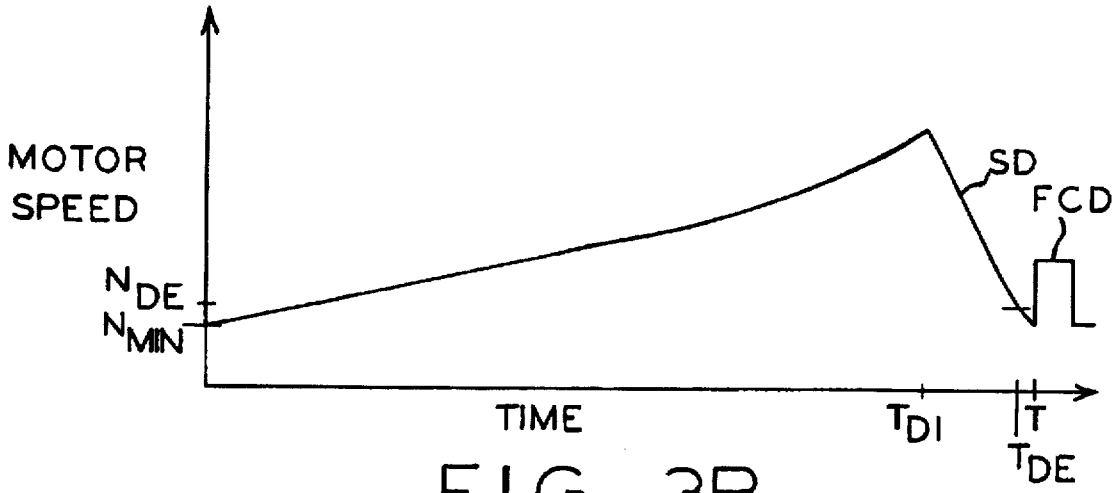
FIG. 3B is a graph illustrating the motor speed vs. time created by an evaporation fan of the invention as frost or ice builds on the evaporator coils between defrost cycles at constant air flow.

FIG. 3B illustrates the motor speed when operating continuously in a constant CFM mode. It is contemplated that the evaporator motor may detect when an actual defrost is in progress, when the defrost cycle should be terminated, i.e., when the frost is off the evaporator coils, and when the defrost cycle is complete and refrigeration is ready to resume. There is also a need to provide increased air flow just after the defrost cycle to recover from the warmer defrost condition. FIG. 3B shows the motor speed when a defrost has been initiated at time $T_{DI}$ with the motor running. The speed drops as indicated at SD as the frost and ice are melted from the evaporator coils causing a lower static operating condition. The motor control 208 monitors the speed as it maintains constant air flow to detect this change and discontinues the defrost request at time $T_{DE}$ when the motor speed is $N_{DE}$ which is a delta value above a minimum or reference stored speed $N_{MIN}$. The speed continues to drop for a short period of 30–90 seconds from $T_{DE}$ to T due to the time momentum of the defrost cycle. In other words, when the motor speed reaches $N_{DE}$, this is an indication to the refrigeration controller 110 to terminate the defrost cycle. Thereafter, the air flow can be set to a value which would provide a fast cool down FCD beginning at time T (after the speed is stable) to recover after the defrost cycle for a delta period of time. This is illustrated by the flow chart of FIG. 5C discussed below. Preferably, this fast cool down comprises a period of time of increased air flow. In the case of a motor having a speed which is directly proportional to air flow, this fast cool down comprises a period of time as indicated by FCD during which the motor speed is increased to a second speed different from the first speed to increase air flow and heat transfer and to quickly cool the compartment air after the defrost cycle. In the case of a motor which increases in speed or torque with increasing air flow, this second speed or torque would be greater than the first speed or torque. In the case of a motor which decreases in speed or torque with increasing air flow, this second speed or torque would be less than the normal (first) speed or torque for achieving constant air flow during normal (nondefrost) operation. This fast cool down period may be initiated at any time after the defrost cycle, but preferably some time after the 30–90 seconds needed to complete the defrost cycle momentum.

Alternatively, a defrost enable signal may be generated by motor 120 when the torque of the motor 120 changes such as by being above a maximum or reference torque. For example, sensing circuit 216 would sense current indicating the torque of the motor. S/T memory 220 would store a maximum or reference torque to which the motor control 208 would compare the sensed torque. When the sensed torque was greater than the maximum or reference torque due to frost or ice build up, motor control 208 would generate a defrost enable signal.

Alternatively, motor control circuit 208 may include a timer 222 which is initiated after a defrost cycle to establish the maximum or reference speed or torque or minimum air flow rate. After the defrost cycle, frost or ice on the evaporator coils would be minimized which would maximize efficiency. The timer would time out a relatively short period of time after the defrost cycle or after the cool down cycle, such as 30 seconds–90 seconds to allow evaporator motor 120 to stabilize operation. After timer 222 has timed out, the speed/torque signal generated via line 218 would then be stored in speed/torque memory 220 indicating a value of the speed or torque of the motor when little or no frost or ice is on the evaporator coils. Thereafter, motor control 208 would control the motor to produce a constant air flow rate and compare the speed/torque signal via line 218 with the value stored in memory 220. When the speed/torque signal indicated an increase in speed or torque beyond a certain delta value above the stored value, motor control 208 would initiate a defrost cycle by generating a defrost enable signal. Motor control 208 would receive an indication that the defrost cycle is complete or sense a decrease in motor speed and/or torque in order to initiate the timer. For example, control 208 could receive a defrost cycle signal from circuit 110 indicating that a defrost cycle has begun. Control 208 could be programmed with the time of a defrost cycle or could detect the end of the defrost cycle be sensing a drop in motor speed or torque below a minimum or reference indicating that defrosting has been accomplished. After timing out or detecting the end of the defrost cycle, timer 222 would be initiated. Alternatively, control 208 could receive a defrost cycle signal for the period that defrosting occurs. When the defrost cycle signal is discontinued, timer 222 could be initiated.

Figure 5C:
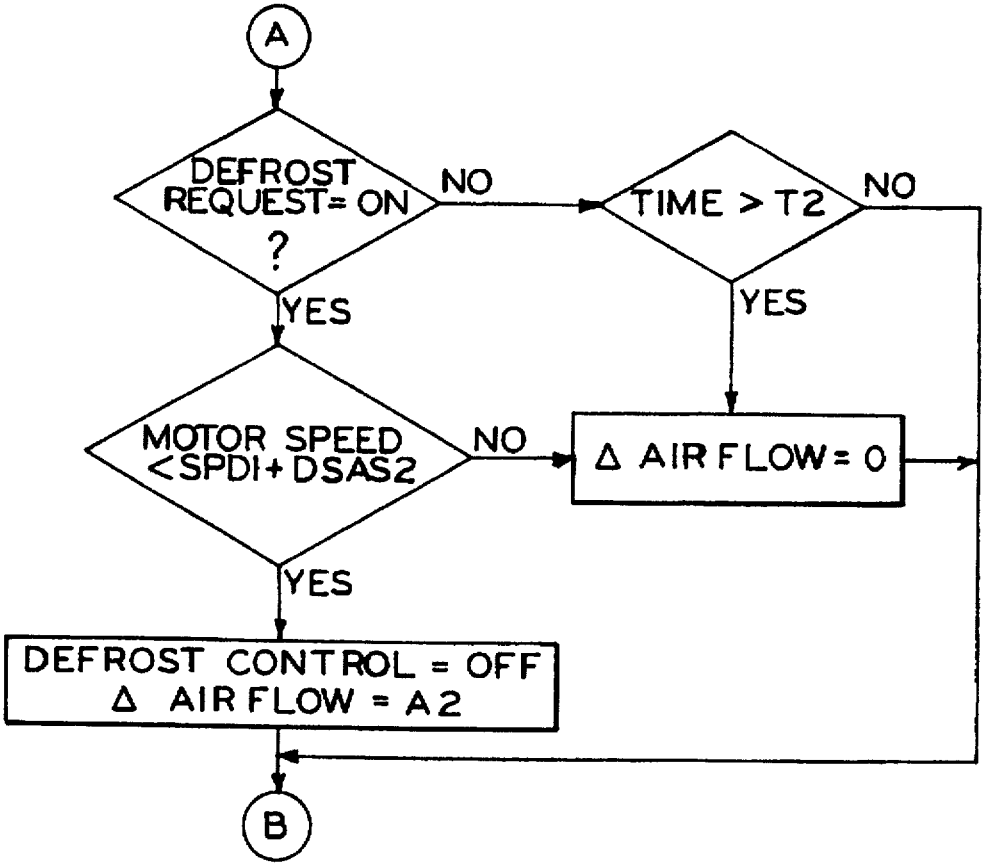
FIG. 5C is a flow chart illustrating an increased delta air flow operation after a defrost cycle of an evaporator motor according to the invention.
Figure 5A:
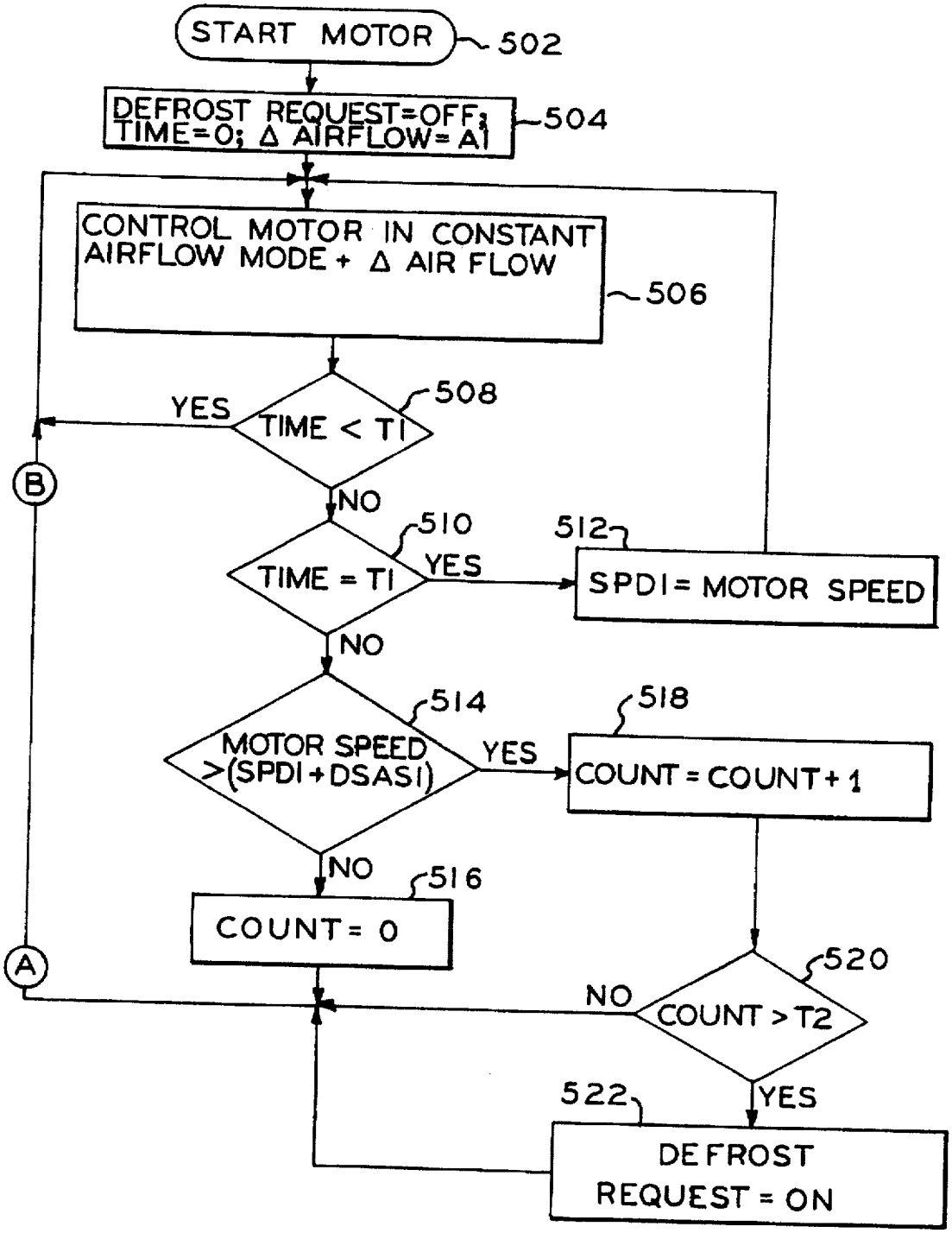
FIGS. 5A and 5B are flow charts illustrating speed and torque control operation at a constant air flow rate of an evaporator motor according to the invention.

FIG. 5A is a flow chart illustrating speed control for constant air flow operation of an evaporator motor 120 of FIG. 1 according to the invention. The motor is started at step 502 and the timer 222 is reset to zero and the initial delta air flow is set to A1 to begin its count at step 504. Motor 120 is controlled in a constant air flow rate by step 506. For example, if the fan is a non-propeller fan such as a squirrel cage, motor 120 may be controlled as a draft inducer which provides constant pressure in accordance with a curve providing a three piece linear fit such as disclosed in the below-noted patents. If the fan is a propeller fan, it may be controlled as noted below in FIG. 7 to achieve constant air flow. Constant air flow rates are preferred because such rates tend to maintain the air curtain formed in commercial refrigeration compartments. Step 508 determines whether the timer 222 has timed out. Time T1 is the period of time to which timer 222 counts. If the timer is less than time T1, motor control circuit 208 returns to step 506 to continue constant air flow control. When the timer has timed out and equals time T1, the control circuit 208 proceeds from step 508 to step 510 to step 512 which stores the motor speed (SPD1) indicated by speed/torque signal 218 in memory 220 at step 512. The control circuit 208 then returns to step 506 for constant air flow control.

Since the timer 222 is now timed out and is greater than time T1, control circuit 208 proceeds through steps 508 and 510 to step 514 and compares the motor speed as indicated by speed/torque signal 218 to the motor speed value SPD1 stored in memory 220 by step 212. If the value of the motor speed is less than the motor speed value SPD1 plus a delta value DSAS1, circuit 208 proceeds to step 516 and sets a count to zero. This requires the motor speed to be greater than the defrost value for T4 consecutive time periods. Thereafter, the circuit 208 returns to constant air flow mode until at step 614 the motor speed is greater than SPD1 plus a delta value DSAS1. At this point, circuit 208 proceeds to step 518 and adds one to the count and then proceeds to step 520. If the count is greater than a preset number such as T2 indicating that the motor speed is consistently above SPD1 plus DSAS1 for a given period of time, circuit 208 proceeds to step 522 and generates a signal indicating a defrost request or enable and then continues with the air flow control at the beginning of the loop by proceeding back to step 506. Otherwise, circuit 208 proceeds from step 520 back to step 506 to maintain constant air flow control. Points A and B indicate where optional continuous operation according to FIG. 5C, described below, may be inserted.

Figure 5B:
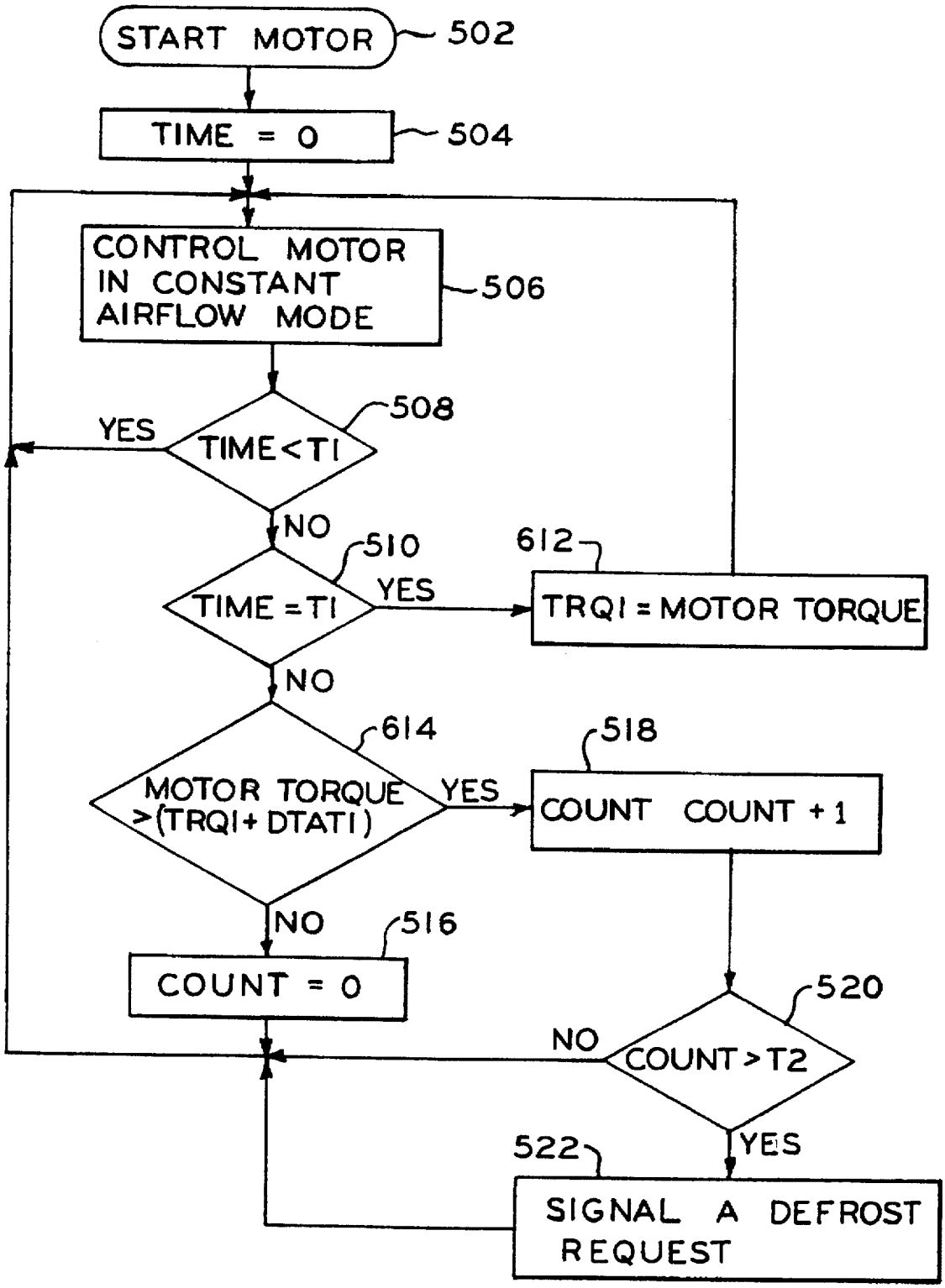

FIG. 5B corresponds to FIG. 5A with torque control instead of speed control. When the timer has timed out and the timer equals time T1, the control circuit 208 proceeds from step 510 to step 612 which stores the motor torque indicated by speed/torque signal 218 in memory 220 at step 512. The control circuit 208 then returns to step 506 for constant air flow control. Since the timer is now timed out and is greater than time T1, control circuit 208 proceeds through steps 508 and 510. Since the timer is greater than time T1, circuit 208 proceeds to step 614 and compares the motor torque as indicated by speed/torque signal 218 to the motor torque value TRQ1 stored in memory 220 by step 612. If the value of the motor torque is less than the motor torque value TRQ1 plus a delta value DTAT1, circuit 208 proceeds to step 516 and sets a count to zero. Thereafter, the circuit 208 returns to constant air flow mode until at step 514 the motor torque is greater than TRQ1 plus DTAT1. At this point, circuit 208 proceeds to step 518 and adds one to the count and then proceeds to step 520. If the count is greater than a preset number such as T2 indicating that the motor torque is consistently above TRQ1 plus DTAT1 for a given period of time T2, circuit 208 proceeds to step 522 and generates a signal indicating a defrost request or enable. Otherwise, circuit 208 proceeds from step 520 back to step 506 to maintain constant air flow control.

In summary, FIG. 5B is a flow chart illustrating torque control operation of an evaporator motor 120 according to the invention. FIG. 5B includes the same steps as FIG. 5A except that steps 512 and 514 have been replaced by steps 612 and 614. In other words, constant air flow is maintained by monitoring the torque at step 512 and by comparing the monitored torque to the torque TRQ1 at the time T1 plus a delta torque value DTAT1 at time T1.

FIGS. 5A and 5B assume that the evaporator fan may not operate during the defrost cycle. However, as shown in FIG. 3B, it is contemplated that the fan may operate continuously. FIG. 5C illustrates such continuous operation for speed control and would be executed between points A and B of FIG. 5A. If there is no defrost request and the time is less than a preset time T3, no change to the fan speed is made. If there is a defrost request and the speed is above SPD1 plus DSAS2, or if the timer has timed out, the delta air flow is set to zero. Otherwise, if the motor speed is below SPD1 plus DSAS2 indicating that no more frost is on the coils, the defrost control is turned off which signals the refrigeration controller that the defrost cycle is in progress. The delta air flow is then set to an increased value A2 to cool down quickly after defrost, the cool down could be delayed until time T4 to allow the evaporator to get cold. When the timer times out T3, the delta air flow is again set to zero for normal operation. FIG. 5B may be similarly adapted to provide continuous operation for torque control.

Figure 6:
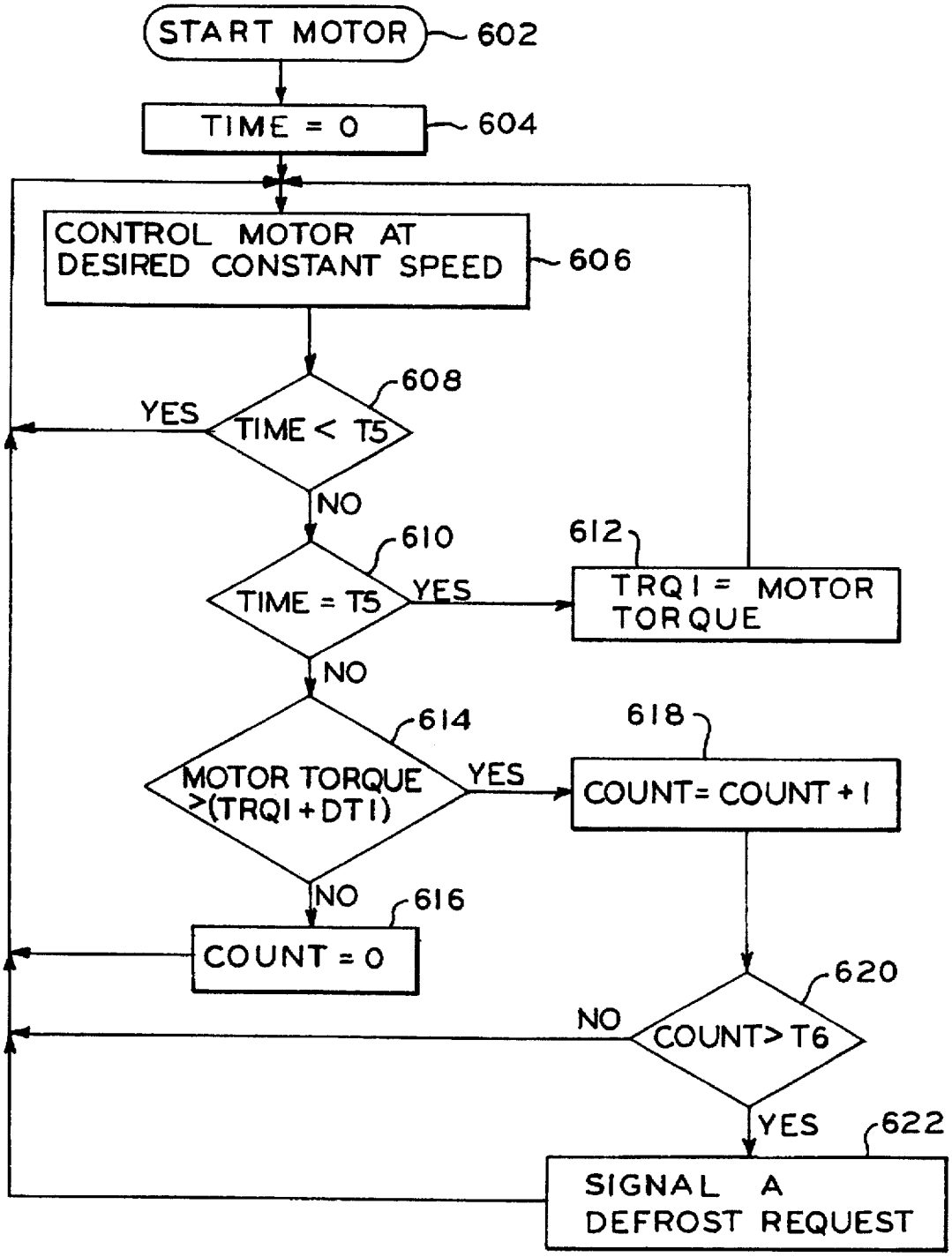
FIG. 6 is a flow chart illustrating torque control operation at a constant speed of an evaporator motor according to the invention.

FIG. 6 is a flow chart illustrating torque control operation of the evaporator motor 120 at constant speed. The motor starts at step 602 and initiates timer operation at step 604. Thereafter, at step 606, the motor is controlled at a desired constant speed. As frost or ice builds on the evaporator coils, the speed will be maintained constant but the torque will increase due to the increased resistance to air flow and the increased static pressure, as indicated by FIGS. 3 and 4. Until the timer times out, the motor is controlled at the desired constant speed. At step 608, when the timer has timed out and the timer is equal to the period of time T5, circuit 208 proceeds to step 610 confirming that the timer is timed out and then proceeds to step 612 to store in memory 220 the motor torque TRQ1 at the time out point. In particular, value TRQ1 is stored in memory 220 indicating the torque of the motor at the end of the timing period. The motor control circuit 208 returns to step 606 to provide constant speed control of the motor. When the timer is greater than the time out period T5, circuit 208 proceeds to step 614. If the motor torque is equal to or less than TRQ1 plus a delta value DTI, the circuit 208 proceeds to step 616 setting the count at zero and returning to step 606 to provide constant speed control. If the motor torque as indicated by speed/torque signal 218 is greater then TRQ1 plus a delta value DT1, circuit 208 begins counting at step 618. When the count reaches a number greater than value T6, indicating that the motor torque has been greater than TRQ1 plus DT1 for a given period of time, the circuit 208 proceeds to step 622 to indicate a defrost enable or request signal.

The constant air flow rate control for squirrel cage blowers, as described in U.S. Pat. Nos. 4,638,233, 4,806,833, 4,978,896, 5,019,757, 5,075,608 and 5,418,438 incorporated herein by reference in their entirety, does not necessarily work on all types of propeller fans. This is because of instabilities and transients on propeller fans, particularly those fans that have small or no shrouds. On a squirrel cage blower, higher CFM's require increased torque, i.e., the increased CFM curves move in the increased torque direction with higher speeds for the same static pressure. On the other hand, for propeller fans, the increased CFM curves require increased speed. Because of this distinction, it is preferable that the CFM control of the invention for propeller fans operate according to the following method including the steps of:

Setting the torque to the motor at a particular torque;

Waiting for a sufficient period of time for the speed of the motor to stabilize at the set torque;

Calculating the time in state for this torque set point that would provide the desired CFM;

Reducing the torque set point if the calculated time in state is greater than the actual time in state; and Increasing the torque set point if the calculated time in state is less than the actual time in state.

The above loop is repeated until a stable speed and torque configuration for the desired CFM curve has been achieved. In the above loop, state is an indication of motor speed.

Figure 7:
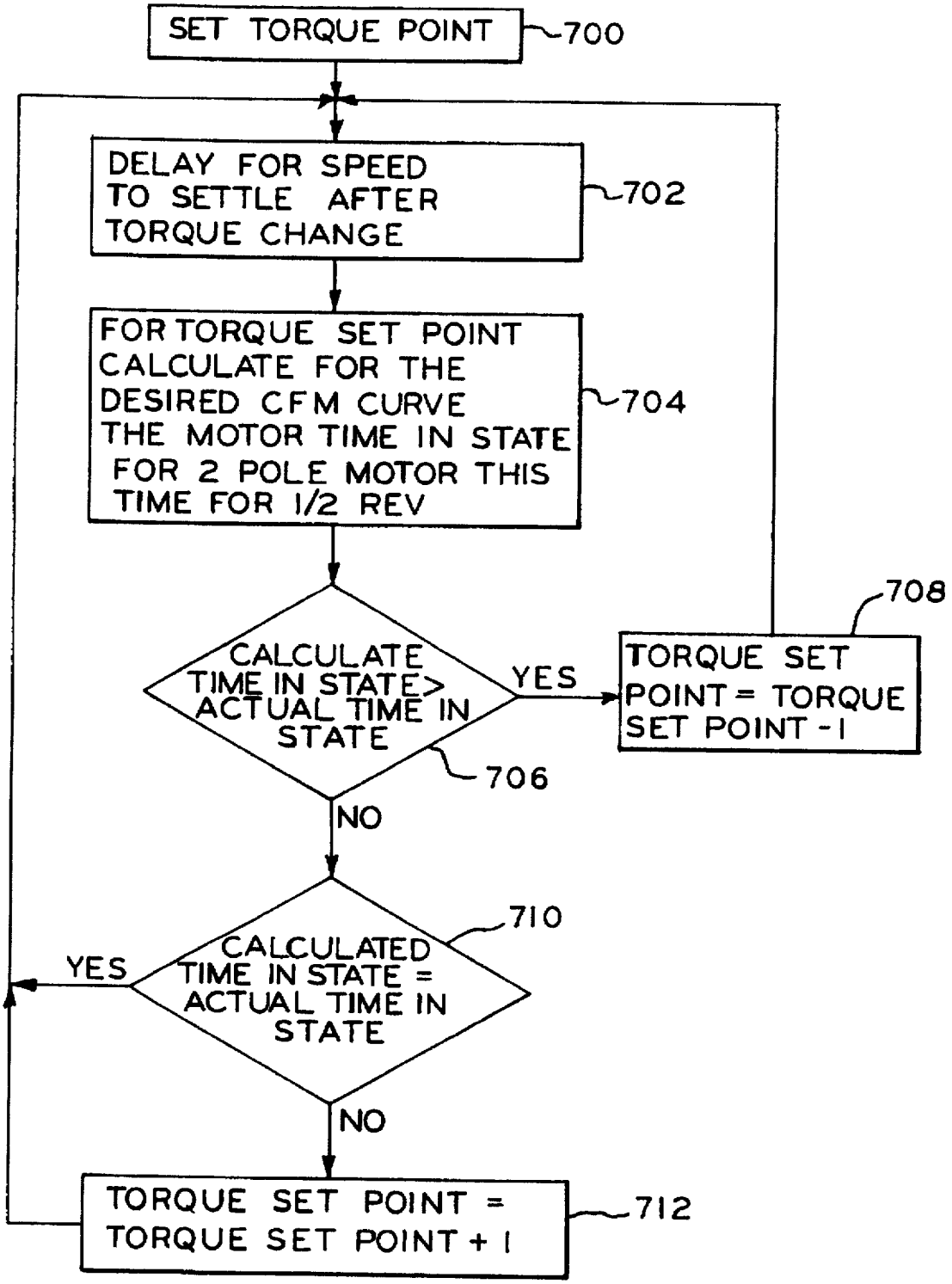
FIG. 7 is a flow chart illustrating constant air flow control for a propeller fan driven by an evaporator motor according to the invention.

FIG. 7 illustrates one preferred embodiment of a flow chart for implementing this system of operation. At step 700, the torque point is set. Thereafter, step 702 implements a delay to allow the speed to stabilize after the torque set point change according to step 1 if any change is implemented. Step 704 calculates the final motor speed (FMSPD). This calculated motor speed is determined by calculating from the torque point set by step 700, 708 or 712 and from the desired CFM curve, the motor time in state. For a single phase, two pole motor, this time in state times two is the inverse of the speed and equals the period.

At step 706 this time in state, which would be the target speed (TARGSPD) is compared to the actual time in state (TINPS). If the calculated time in state is greater than the actual time in state, the processor proceeds to step 708 to reduce the torque set point by 1 count and returns to the beginning of the control loop to re-execute step 702 and the steps following it.

If the calculated time in state is equal to or less than the actual time in state, the controller proceeds to step 710. If the calculated time in state is equal to the actual time in state, no changes are made and the processor proceeds to step 702 to re-execute the loop. On the other hand, if the calculated time in state is less than the actual time in state, the processor proceeds to step 712 wherein the torque set point is increased by one count and then the processor returns to step 702 to reexecute the control loop.

Figure 8:
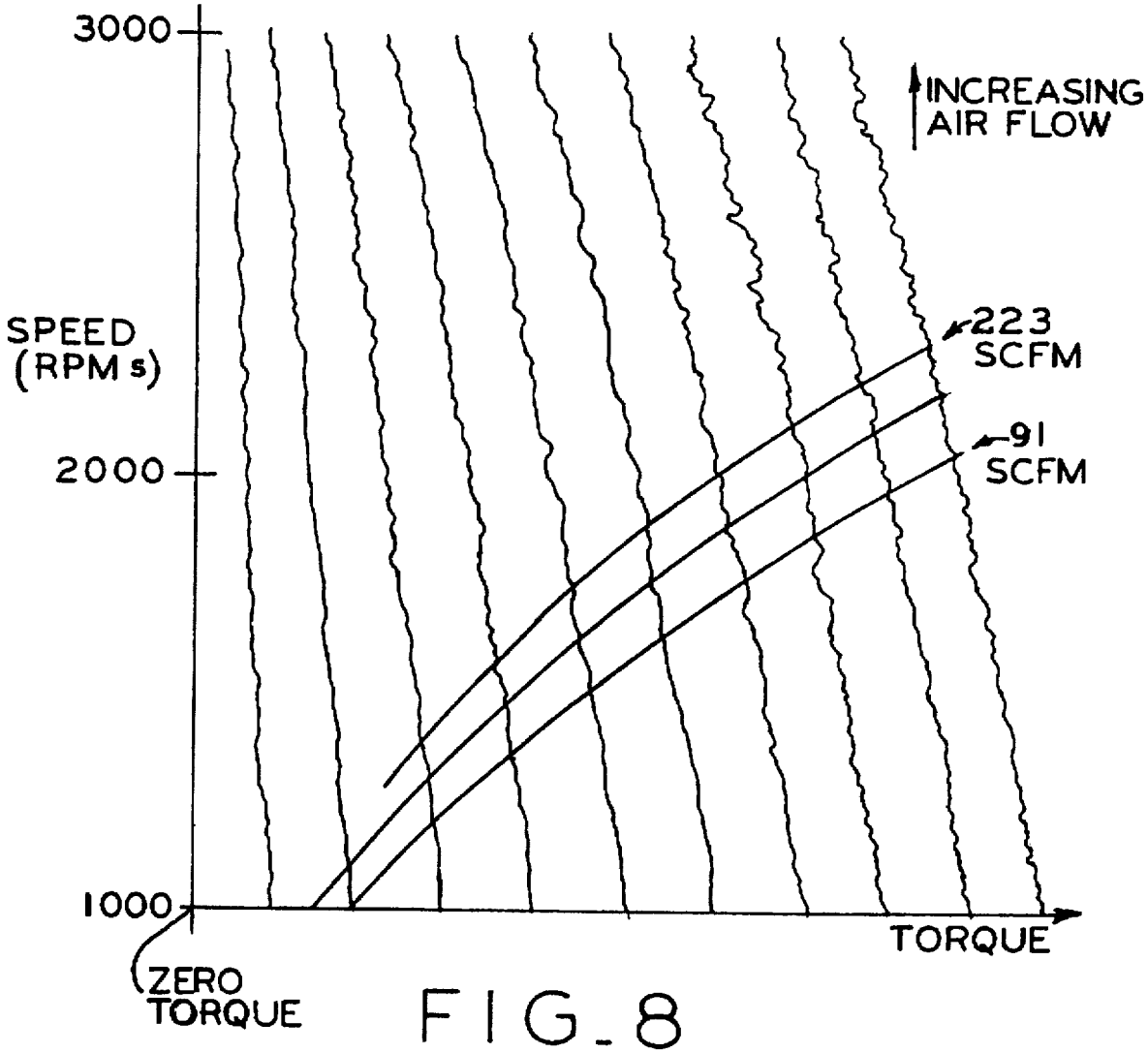
FIG. 8 is a graph of selected constant air flows of speed vs. torque curves for an evaporator motor according to the invention.

FIG. 8 is a torque profile of one preferred embodiment of a speed-torque profile for selected air flows for an evaporator motor according to the invention in which increased ice build up results in increased speed and torque in order to maintain constant air flow. FIG. 8 illustrates three constant standard CFM curves (corrected for pressure) with speed (RPMs) along the y-axis and torque along the x-axis. The slanted curves are profiles of torque and speed set by a constant duty cycle command. Each curve represents a higher constant air flow rate than the curve to its left. As illustrated, the CFM curves confirm that the motor according to the invention operates within an acceptable range.

Figure 9:
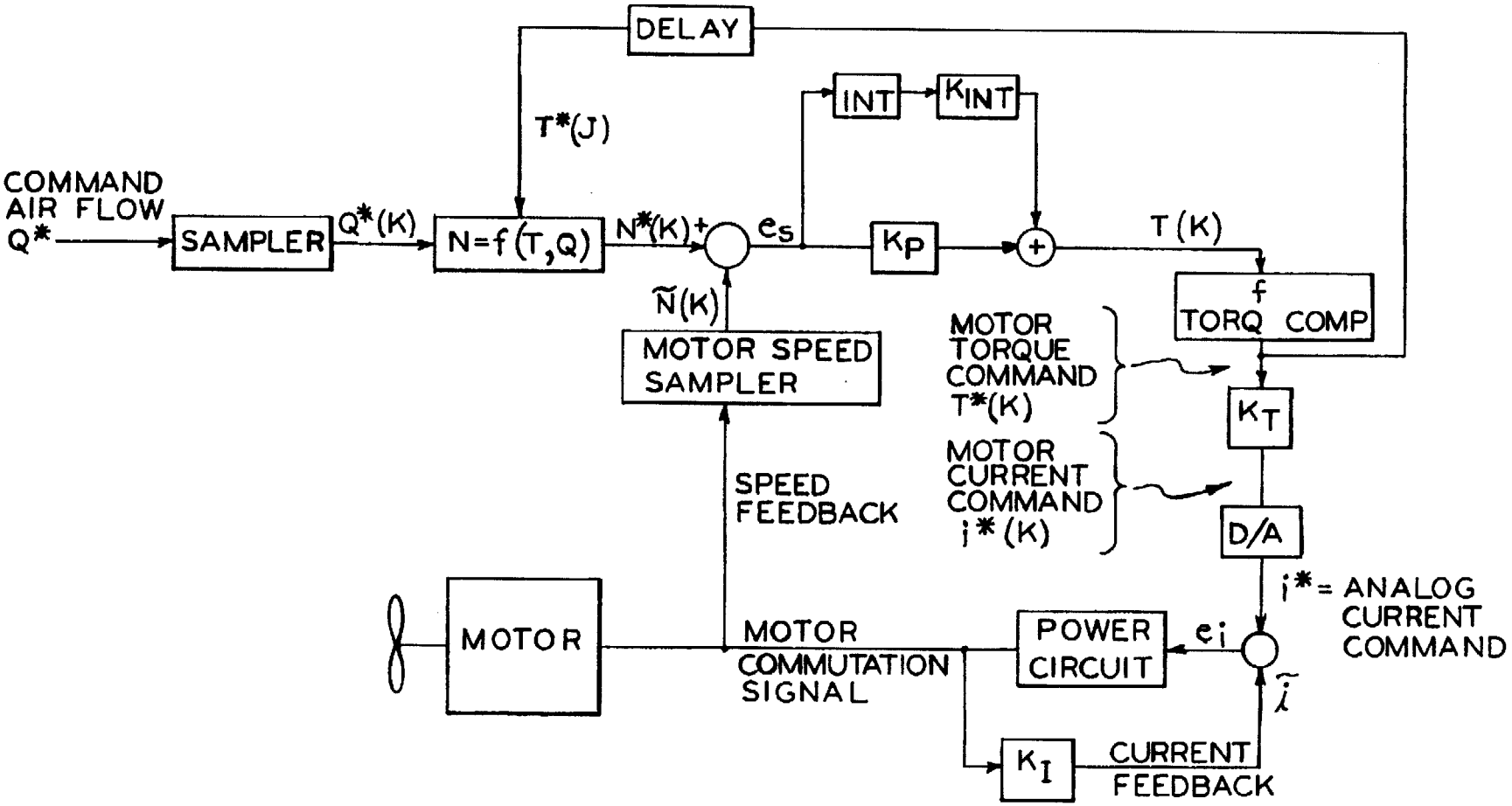
FIG. 9 is a block diagram of the functional operation of a control circuit for an evaporator motor according to the invention which controls speed and torque of an electronically controlled motor in such a way that the motor in combination with a propeller fan operates within a profile set by a commanded air flow.

FIG. 9 is a block diagram of the functional operation of a control circuit for an evaporator motor according to the invention which controls speed and torque of an electronically commutated motor in such a way that the motor in combination with a propeller fan operates within a profile set by a commanded air flow. This is a speed motor regulation block diagram for a motor. The following table summarizes the values illustrated in FIG. 9.

TABLE OF FIG. 9 SYMBOLS

| | |
|---|---|
| Q* = | commanded air flow |
| Q*(k) = | sampled commanded air flow |
| N = | motor speed, a function of torque, air flow |
| N*(k) = | commanded motor speed |
| N(k) = | discrete actual speed |
| $e_s$ = | speed error |
| Kp = | proportional gain |
| INT = | error integrator |
| $K_{INT}$ = | integrator gain |
| T(k) = | motor torque |
| T(j) = | delayed motor torque |
| f = | linearization and torque compensation |
| T*(k) = | motor torque command |
| $K_T$ = | torque to current conversion factor |
| i*(k) = | motor current command |
| i* = | analog current command |
| $K_I$ = | current sample scale factor |
| " " = | discrete actual current |
| $e_i$ = | current error |

N* (k) is the commanded motor speed calculated for a given CFM which is compared to discrete actual speed N(k) to produce a speed error signal $e_s$. The resulting motor torque signal T(k) is conditioned by f which provides linearization and torque compensation, converted to an analog signal and applied to a power circuit including an inverter. The resulting signal is used to commutate the motor. The circuit also includes current and speed feedback loops based on motor commutation to maintain stable motor operation.

Figure 10:
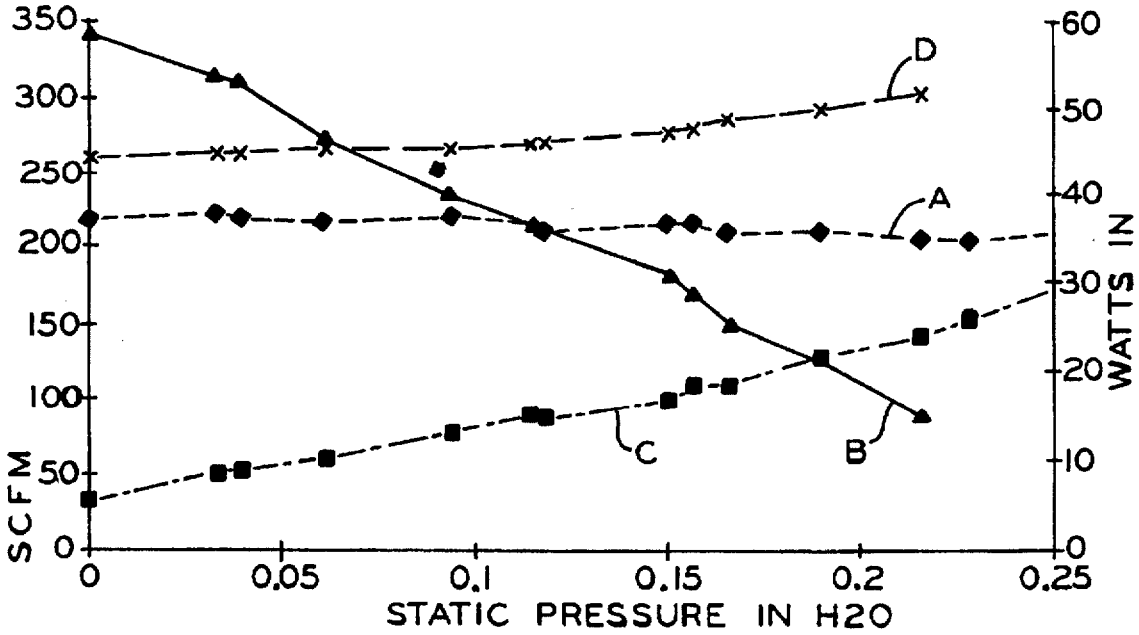
FIG. 10 is a graph illustrating a comparison between the air flow (SCFM) and watts vs. static pressure of one preferred embodiment of an evaporator motor according to the invention and the air flow and watts of a conventional motor driving a propeller fan.

FIG. 10 is a graph illustrating a comparison between the air flow and watts of one preferred embodiment of an evaporator motor according to the invention and the air flow and watts of a conventional uncontrollable motor driving a propeller fan. FIG. 10 illustrates that the motor according to the invention provides an approximately constant SCFM of about 220 as indicated by curve A. In contrast, curve B shows that a prior art motor does not provide a constant air flow SCFM. Curve C illustrates that the power requirements in watts for the motor of the invention varies from about 10 to 30 watts whereas curve D illustrates that the power requirements in watts for the prior art motors varies from about 45 to 50 watts.

Figure 11:
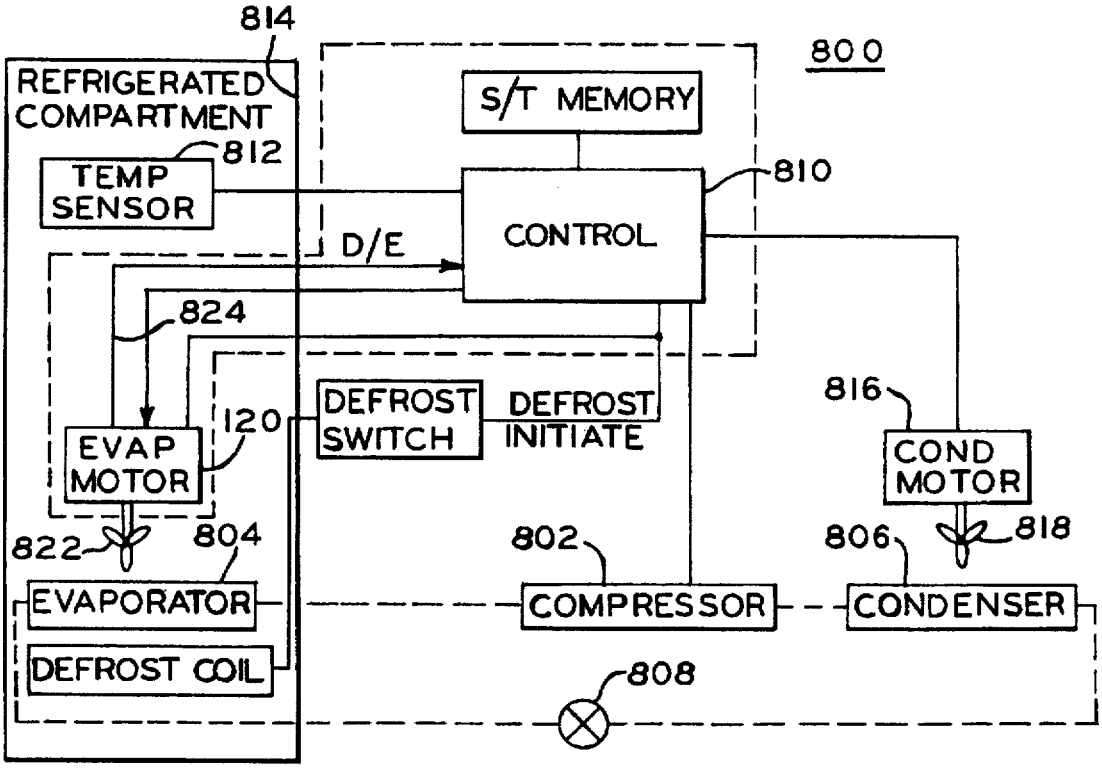
FIG. 11 is a block diagram of a consumer refrigeration system including an evaporator motor of the invention.

FIG. 11 is a block diagram of a consumer refrigeration system 800 according to the invention. System 800 would normally be employed in a home and includes a single compressor 802 for compressing a working fluid to be evaporated in an evaporator 804 and to be condensed in a condenser 806. An expansion valve 808 as is known in the art divides the condenser and evaporator sections of the working fluid system.

A refrigeration controller circuit 810 (which may be part of evaporator motor 804) initiates operation of a refrigeration cycle in response to temperature sensor 812 which monitors the temperature in the refrigerator compartment 814. Controller circuit 810 also controls a condenser motor 816 which drives air moving assembly 818, such as a propeller to circulate air over the condenser 806 and to cool the condenser.

Refrigeration control circuit 810 may also energize evaporator motor 120 which drives an air moving assembly 822 such as a fan blade assembly having a shroud (not shown) for circulating air within the refrigerator compartment 814 to be cooled. As noted above, evaporator motor 820 may be any controllable motor typically powered by an electronic commutating circuit. In general, evaporator motor 820 includes a rotatable assembly in driving relation to the air moving assembly 822. Evaporator motor 820 generates a defrost enable signal via line 824 to signal refrigerator control circuit 810 that a defrost cycle should be initiated. Circuit 810 may not immediately initiate a defrost cycle. For example, circuit 810 may be programmed to permit defrost cycles only during certain times of the day or night and, during certain high peak or high demand times, provide refrigeration rather than initiating a defrost cycle. FIG. 2 illustrates in block diagram form one preferred embodiment of the evaporator motor 120 according to the invention. As with the commercial system 100 of FIG. 1, the consumer system 800 of FIG. 11 would initiate defrost cycles in response to frost or ice build up on the evaporator coils 804. Motor control circuit 208 includes timer 222 which is initiated after a defrost cycle. The defrost initiate signal may indicate the beginning of a defrost cycle, in which case control 208 would be programmed with the period of the defrost cycle. Alternatively, the defrost initiate signal may be discontinued to indicate the end of the defrost cycle. In either case, the timer 222 would time out a relatively short period of time after the defrost cycle to allow the evaporator motor 120 to stabilize operation. After timer 222 has timed out, the speed/torque signal generated via line 218 would then be stored in speed/torque memory 220 indicating a value of the speed or torque of the motor when little or no frost or ice is on the evaporator coils. Thereafter, motor control signal 208 would control the motor to produce a constant air flow rate over the evaporator and compare the speed/torque signal necessary to generate such constant air flow rate and provided via line 218 with the value stored in memory 220. When the speed/torque signal indicated an increase in speed or torque beyond a certain delta value above the stored value, motor control 208 would initiate a defrost cycle by generating a defrost enable signal.

In view of the above, it will be seen that the several objects of the invention are achieved and other advantageous results attained.

As various changes could be made in the above systems, products and method without departing from the scope of the invention, it is intended that all matter contained in the above description and shown in the accompanying drawings shall be interpreted as illustrative and not in a limiting sense.

APPENDIX A

```
964   02E9  6F                  RBIT        7, [B]
965                   ;           STATE = 0
966   02EA  BC4000              LD          STATE, #0
967                   ;           GOTO LOOP;
968   02ED  2046                JMP         LOOP
969
970                   MR70:
971                   ;         IF PRSDF THEN GOTO LOOP;
972   02EF  58                  LD          B, #FLAG1
973   02F0  77                  IFBIT       PRSDF, [B]
974   02F1  2046                JMP         LOOP
975                   ;           PRSDF = 1;
976   02F3  7F                  SBIT        PRSDF, [B]
977
978                   ;           IF TIME < LOOPTIME THEN GOTO LOOP;
979   02F4  9D31                LD          A,LOOPTIME
980   02F6  BD0EB3              IFGT        A,TIME
981   02F9  2046                JMP         LOOP
982                   ;           TIME = 0;
983   02FE  BC0E00              LD          TIME,#0
984
985                   ;           if nfirsttimeflag = 0 then trqx = ltrq0;
986                   ;             NFIRSTTIMEFLAG = 1;
987   02FE  58                  LD          B,#FLAG1
988   02FF  76                  IFBIT       NFIRSTIMEFLAG, [B]
989   0300  05                  JP          FIRSTDONE
990   0301  9D20                LD          A,LTRQ0
991   0303  9C39                X           A,TRQX
992   0305  7E                  SBIT        NFIRSTIMEFLAG, [B]
993                   FIRSTDONE:
994
995                   ;         IF TINPS < MINTINPS THEN GOTO COMPA7;
996   0306  9B59                LD          A,#MINTINPS
997   0308  BD0A83              IFGT        A,TINPS
998   0308  23E5                JMP         COMPA7
999
1000                  ; **        B = LTRQ0; /* pointer */
1001  030D  DE20                LD          B,#LTRQ0          ; load pointer
1002
1003                  ;           here are constant CFM calculations
1004
1005                  CALCCFMSPD:
1006  030F  AA                  LD          A,[B+]
1007  0310  BD3983              ZFGT        A,TRQX
1008  0313  23FB                JMP         BELOWTRQ0
1009  0315  AA                  LD          A,[B+]
1010  0316  BD3983              IFGT        A,TRQX
1011  0319  2380                JMP         CF4               ; calculate trq
1012  031B  AA                  LD          A,[B+]
1013  031C  BD3983              IFGT        A,TRQX
1014  031F  2380                JMP         CF4               ; calculate trq
1015  0321  AA                  LD          A,[B+]
1016  0322  BD3983              IFGT        A1TRQX
1017  0325  2380                JMP         CF4               ; calculate trq
1018  0327  AA                  LD          A,[B+]
1019  0328  BD3983              IFGT        A,TRQX
1020  032B  2380                JMP         CF4               ; calculate trq
1021  032D  AA                  LD          A,[B+]
1022  032E  BD3983              IFGT        A,TRQX
1023  0331  2380                JMP         CF4               ; calculate trq
1024  0333  AA                  LD          A,[B+]
1025  0334  BD3983              IFGT        A,TRQX
1026  0337  2320                JMP         CF4               ; calculate trq
1027  0339  AA                  LD          A,[B+]
1028  033A  BD3983              IFGT        A,TRQX
1029  033D  2320                JMP         CF4               ; calculate trq
1030  033F  AA                  LD          A,[B+]
1031  0340  BD3983              IFGT        A,TRQX
1032  0343  2320                JMP         CF4               ; calculate trq
1033  0345  AA                  LD          A,[B+]
1034  0346  BD3963              IFGT        A,TRQX
1035  0349  2320                JMP         CF4               ; calculate trq
1036  034B  AA                  LD          A,[B+]
1037  034C  BD3923              IFGT        A,TRQX
1032  034F  2320                JMP         CF4               ; calculate trq
1039  0351  AA                  LD          A,[B+]
1040  0352  BD3963              IFGT        A,TRQX
1041  0355  2380                JMP         CF4               ; calculate trq
1042  0357  AA                  LD          A,[B+]
```

```
1043  0358  BD3983                IFCT    A,TRQX
1044  035B  2380                  JMP     CF4          ; calculate trq
1045  035D  AA                    LD      A,[B+]
1046  035E  BD3983                IFGT    A,TRQX
1047  0361  2360        R         JMP     CF4          ; calculate trq
1048  0363  AA                    LD      A,[B+]
1049  0364  BD3923                IFGT    A,TRQX
1050  03G7  2380                  JMP     CF4          ; calculate trq
1051  0369  AA                    LD      A,[B+]
1052  036A  BD3923                IFGT    A,TRQX
1053  036D  2320                  JMP     CF4          ; calculate trq
1054  03GF  AA                    LD      A,[B+]
1055  0370  BD3983                LFGT    A,TRQX
1056  0373  2380        R         JMP     CF4          ; calculate trq
1057  0375  AE                    LD      A,[B]
1058  0376  BD3983                LFGT    A,TRQX
1059  0379  07                    JP      CF4A1
1060
1061                    ;                                RPM above RPM3
1062                    ARPMA:
1063  037A  9D1F                  LD      A,LRPM16
1064  037C  9C34                  X       A,TARGSPD
1065  037E  23B2                  JMP     COMPTRQX
1066
1067                    CF4:      ; do 3 piece linear fit for motor torque
1068                                                     TARGSPD = TINPS(B-1)
(TRQX-TRQ (B-1))/CTRQ(B)-TRQ(B-1))*
1069                    ;         (TINPS(B-1)-TINPS(B));
1070
1071  0380  AB                    LD      A,[B-]       ; decrement B reg
1072                    CF4A1:
1073  0381  AB                    LD      A,[B-]
1074  0382  A1                    SC
1075  0383  81                    SUBC    A,[B]; TRQ(B)-TRQ(B-1)
1076  0384  9C03                  x       A,D1V168
1077  0386  BC0000                LD      DQ16BL,#0
1078  0389  9D39                  LD      A,TRQX
1079  038B  A1                    SC
1080  038C  81                    SUBC    A,[B]        ; TRQX-TRQ(B-1)
1081  038D  9C01                  x       A,DQ168H
1082  038F  9DFE                  LD      A,B
1083  0391  9C38                  X       A,BSAV       ; save B, destroyed in math routine
1084  0393  3435                  JSR     FDV168
1085  0395  9D38                  LD      A,BSAV
1086  0397  94EF                  ADD     A,#-17       ; move B to point to respective
TINPS(B-1)
1087  0399  9CFE                  X       A,B
1088                    ;                                result in 0 (MPCAND)
1089  039B  AA                    LD      A,[B+]       ; load TINPS(B-1)
1090  039C  A1                    SC
1091  039D  S1                    SUBC    A;[B]        ; TINPS(B-1)-RPN(B)
1092  039E  9C01                  X       A,MULPLIER
1093  03A0  9DFE                  LD      A,B
1094  03A2  9C38                  X       A,BSAV       ; save B, destroyed in math routine
1095  03A4  3458                  JSR     MPYB8
1096  03A6  9D38                  LD      A1BSAV
1097  03A8  8B                    DEC     A
1098  03A9  9CFE                  X       A,B          ; restore B
1099  03AB  AE                    LD      A,[B]
1100  03AC  A1                    SC
1101  03AD  BD0281                SUBC    A,PRODH
1102  03B0  9C34                  x       A,TARGSPD
1103                    COMPTRQX:
1104                    ;         IF TARGSPD > TINPS THEN GOTO COMP1;
1105  03B2  9D34                  LD      A,TARGSPD
1106  03B4  BD0A83                IFGT    A,TINPS
1107  03B7  23DC                  JMP     COMP1
1108                    ;         IF TARGSPD = SPD THEN GOTO LOOP
1109
1110  03B9  BD0AB2                IFEQ    A,TINPS
1111  03BC  2045                  JMP     LOOP
1112
1113                    ;                                TARGSPD < TINPS
1114                    ;         LOOPTIME = 4; /* lower TRQX at 2.5 sec intervals
1115  03BE  BC3104                LD      LOOPTIME,#4
1116                    ;         IF TARGSPD > (TINPS - 150 rpm) THBN GOTO COMP2;
1117  03C1  940C                  ADD     A,#12
1118  03C3  BD0A83                IFGT    A,TINPS
1119  03C6  11                    JP      COMP2
1120                    ;         TRQX = TRQX + 2;
1121  03C7  DE39                  LD      B,#TRQX
1122  03C9  AE                    LD      A,[B]
```

```
1123                ;                INC                A
1124                COMP4:
1125  03CA  8A                       INC                A
1126  03CB  BD3083                   IFGT               A,LTRQ16
1127  03CE  9D30                     LD                 A,LTRQ16          ; max torque
1128  03D0  A6                       X                  A,[B]
1129  03D1  AE                       LD                 A,[B]
1130  03D2  9GFF                     XOR                A,#0FF
1131  03D4  9C3C                     X                  A,TRQSET
1132  03D6  2046                     JMP                LOOP
1133                COMP2:
1134                ;                TRQX = TRQX + 1;
1135  03D8  DE39                     LD                 B,#TRQX
1136  03DA  AE                       LD                 A,[B]
1137  03DB  EE                       JP                 COMP4
1138                COMP1:                                                ; TARGSPD > TINPS
1139
1140                ;                LOOPTIME = 4; /* raise TRQX at 1.0 sec intervals
1141  03DC  BC3104                   LD                 LOOPTIME,#4
1142
1143                ;                IF TARGSPD > (TINPS+100 RPM) THEN GOTO COMP6;
1144  03DF  94F4                     ADD                A,#-12
1145  03E1  BD0A83                   IFGT               A,TINPS
1146  03E4  12                       JP                 COMP6
1147                COMPA7:
1148  03E5  DE39                     LD                 B,#TRQX
1149  03E7  AE                       LD                 A,[B]
1150                COMP7:
1151  03E6  8B                       DEC                A
1152  03E9  BD2083                   IFGT               A,LTRQ0
1153  03EC  02                       JP                 COMP7A
1154  03ED  9D20                     LD                 A,LTRQ0
1155                COMP7A:
1156  03EF  A6                       X                  A, [B]
1157  03F0  AE                       LD                 A, [B]
1158  03F1  96FF                     XOR                A,#OFF
1159  03F3  9C3C                     X                  A,TRQSET
1160  03F5  2046                     JMP                LOOP
1161                COMP6:
1162  03F7  DE39                     LD                 B,#TRQX
1163  03F9  AE                       LD                 A, [B[
1164                ;                DEC                A
1165  03FA  ED                       JP                 COMP7
1166
1167
1168                BELOWTRQ0:
1169  03FB  9D0F                     LD                 A,LRPM0
1170  03FD  9C34                     X                  A,TARGSPD
1171  03FF  23B2                     JMP                COMPTRQX
1172
1173                ;                                   /* end motor RUN */
1174
1175
1176
1177                ;                /* this area process motor position errors */
1178                ;                M_STATE_ERROR: STATE = 3;
1179                MSTATEERROR:
1180  0401  BC4003                   LD                 STATE,#3
1181                                 DEVICEOFFFLAG = 1;
1182  0404  BD077B                   SBIT               DEVICEOFFFLAG,FLAG1
1183                ;                motor outputs = off;
1184  0407  BDD06E                   RBIT               6,PORTLD
1185  040A  BDD06F                   RBIT               7,PORTLD
1186                ;                TIME = 0;
1187  040D  64                       CLR                A
1188  040E  9C0E                     X                  A,TIME
1189                ;                M_ERR1:            /* delay for .5 second then
1190                ;                                   go to idle state*/
1191                MERR1:
1192
1193                ;                motor outputs = off
1194  0410  BDD06E                   RBIT               6,PORTLD
1195  0413  BDD06F                   RBIT               7,PORTLD
1196
1197                ;                IF TIME < 20 THEN GOTO LOOP; /* 10 sec */
1198  0416  51                       LD                 B,#TIME
1199  0417  AE                       LD                 A,[B]
1200  0418  9314                     IFGT               A,#20
1201  041A  02                       JP                 ME6               ; TIME > 100
1202  041B  2046                     JMP                LOOP
1203                ;                TIME = 0;
1204                ME6:
```

```
1205  041D  BC0E00          LD                    TIME,#0
1206                ;       STATE = 0;                          /* set idle state */
1207  0420  BC4000          LD                    STATE,#0
1208                ;       TINPO = 0;
1209  0423  D200            LD                    TINPO,#0
1210                ;       GOTO LOOP;
1211  0425  2046            JMP                   LOOP
1212                ;       M_ERR2:
1213                MERR2:
1214                ;       motor outputs = opposite current outputs
1215  0427  BDD06E          RBIT                  6,PORTLD
1216  042A  BDD06F          RBIT                  7,PORTLD
1217                ;       TIME = 0;
1218  042D  BC0E00          LD                    TIME,#0
```

What is claimed is:

1. An apparatus for use with a refrigeration system including:

a compressor for compressing a working fluid evaporated in an evaporator and condensed in a condenser; and a control circuit for initiating operation of a refrigeration cycle and for initiating a defrost cycle in response to a defrost enable signal;

the apparatus driving an air moving assembly moving air over the evaporator, said apparatus comprising:

a motor including a rotatable assembly in driving relation to the air moving assembly;

an energizing circuit selectively energizing the motor in response to the control circuit to maintain a substantially constant air flow rate over the evaporator;

a sensing circuit generating a speed/torque signal representative of a speed or a torque of the motor; and a defrost initiating circuit responsive to the speed/torque signal and generating the defrost enable signal when the speed/torque signal indicates a change in the motor speed/torque or a change in the motor torque whereby the defrost cycle is initiated in response to degradation of the refrigeration cycle as indicated by frost or ice on the evaporator which reduces air flow through the evaporator and increases static pressure of the air flow.

2. The apparatus of claim 1 comprising a timer for timing a period of time after a defrost cycle and a memory, responsive to the timer, for storing a signal corresponding to the speed/torque signal at the end of the period of time, and wherein the defrost initiating circuit generates the defrost enable signal when the speed or the torque of the motor is greater than the speed or the torque corresponding to the signal stored in the memory.

3. The apparatus of claim 2 wherein the defrost initiating circuit generates the defrost signal when a difference between the actual speed and a reference speed or the difference between the torque and a reference torque is greater than a reference amount.

4. The apparatus of claim 1 wherein the defrost initiating circuit generates the defrost signal when a difference between the speed and a reference speed or the difference between the torque and a reference torque is greater than a reference amount.

5. The apparatus of claim 1 wherein the refrigeration system includes a second air moving assembly moving air over the evaporator, said apparatus comprising:

a second motor including a second rotatable assembly in driving relation to the second air moving assembly; and a second sensing circuit generating a second speed/torque signal representative of a speed or a torque of the second motor;

a second energizing circuit selectively energizing the second motor in response to the control circuit; and wherein the defrost initiating circuit generates the defrost enable signal when the second speed/torque signal indicates a change in the motor speed or the motor torque whereby the defrost cycle is initiated in response to degradation of the refrigeration cycle as indicated by frost or ice on the evaporator which reduces air flow through the evaporator and increases the static pressure of the air flow.

6. The apparatus of claim 1 wherein the refrigeration system includes second and third air moving assemblies moving air over the evaporator, said apparatus comprising:

a second motor including a second rotatable assembly in driving relation to the second air moving assembly; and a third motor including a third rotatable assembly in driving relation to the third air moving assembly; and a second sensing circuit generating a second speed/torque signal representative of a speed or a torque of the second motor;

a third sensing circuit generating a third speed/torque signal representative of a speed or a torque of the third motor;

a second energizing circuit selectively energizing the second motor in response to the control circuit;

a third energizing circuit selectively energizing the third motor in response to the control circuit; and wherein the defrost initiating circuit generates the defrost enable signal when at least two of the first, second, and third speed/torque signals indicate a change in the motor speed or the motor torque whereby the defrost cycle is initiated in response to degradation of the refrigeration cycle as indicated by frost or ice on the evaporator which reduces air flow through the evaporator and increases the static pressure of the air flow.

7. The apparatus of claim 1 wherein the energizing circuit includes a circuit controlling the speed/torque of the motor to maintain an air flow rate greater than the constant air flow rate for a period of time after the defrost cycle.

8. The apparatus of claim 1 wherein the energizing circuit includes a circuit controlling the speed/torque of the motor to maintain a substantially constant speed or torque of the motor.

9. The apparatus of claim 1 wherein the defrost initiating circuit discontinues the defrost enable signal to end the defrost cycle when the torque/speed signal corresponds to an air flow rate which is greater than a reference air flow rate.

10. The apparatus of claim 1 wherein the defrost initiating circuit discontinues the defrost enable signal to end the defrost cycle when the torque/speed signal indicates that the motor speed is less than a reference speed or that the motor torque is greater than a reference torque.

11. The apparatus of claim 1 comprising a timer for timing a period of time after a defrost cycle and a memory, responsive to the timer, for storing a signal corresponding to the speed/torque signal at the end of the period of time, and wherein the defrost initiating circuit discontinues the defrost enable signal when the speed or the torque of the motor is less than the sum of the speed or the torque corresponding to the signal stored in the memory plus a delta value.

12. The apparatus of claim 1 comprising a timer for timing a period of time after a defrost cycle and a memory, responsive to the timer, for storing a signal corresponding to the speed/torque signal at the end of the period of time, and wherein the defrost initiating circuit discontinues the defrost enable signal when the speed or the torque of the motor is greater than the sum of the speed or the torque corresponding to the signal stored in the memory plus a delta value.

13. The apparatus of claim 1 comprising a defrost cycle sensing circuit generating a defrost cycle signal when the speed/torque signal indicates a change in the motor speed or torque representing an defrost cycle; and wherein the control circuit deenergizes the motor for a first period of time in response to the defrost cycle signal whereby the motor does not rotate the air moving assembly during the defrost cycle.

14. The apparatus of claim 13 wherein the defrost cycle signal is provided to the control circuit and wherein the control circuit energizes the motor at a first speed or torque for a second period of time following the first period of time and wherein the control circuit energizes the motor at a second speed or torque different than the first speed or torque following the second period of time.

15. An apparatus for use with a refrigeration system including:

a compressor for compressing a working fluid evaporated in an evaporator and condensed in a condenser; and a control circuit for initiating operation of a refrigeration cycle and for initiating a defrost cycle in response to a defrost enable signal;

the apparatus driving an air moving assembly moving air over the evaporator, said apparatus comprising:

a motor including a rotatable assembly in driving relation to the air moving assembly;

an energizing circuit selectively energizing the motor in response to the control circuit;

a sensing circuit generating a speed/torque signal representative of a speed or a torque of the motor; and a defrost initiating circuit generating the defrost enable signal when the speed/torque signal indicates a change in the motor speed/torque or a change in the motor torque whereby the defrost cycle is initiated in response to degradation of the refrigeration cycle as indicated by frost or ice on the evaporator which reduces air flow through the evaporator and increases static pressure of the air flow; and wherein the energizing circuit includes a circuit controlling the speed/torque of the motor to maintain a motor speed for a period of time after the defrost cycle wherein the maintained motor speed corresponds to greater air flow than the air flow during the constant motor speed.

16. An apparatus for use with a refrigeration system including:

a compressor for compressing a working fluid evaporated in an evaporator and condensed in a condenser; and a control circuit for initiating operation of a refrigeration cycle and for initiating a defrost cycle in response to a defrost enable signal;

the apparatus driving an air moving assembly moving air over the evaporator, said apparatus comprising:

a motor including a rotatable assembly in driving relation to the air moving assembly;

an energizing circuit selectively energizing the motor in response to the control circuit;

a sensing circuit generating a speed/torque signal representative of a speed or a torque of the motor;

a defrost initiating circuit generating the defrost enable signal when the speed/torque signal indicates a change in the motor speed/torque or a change in the motor torque whereby the defrost cycle is initiated in response to degradation of the refrigeration cycle as indicated by frost or ice on the evaporator which reduces air flow through the evaporator and increases static pressure of the air flow; and a fast cool down circuit for operating the motor at an increased speed, torque or air flow rate for a period of time after a defrost cycle.

17. An apparatus for use with a refrigeration system including:

a compartment to be refrigerated;

a temperature sensor for sensing the temperature in the compartment;

a compressor responsive to the temperature sensor for compressing a working fluid evaporated in an evaporator for cooling the compartment and condensed in a condenser remote from the compartment; and a defrosting circuit for defrosting the evaporator during a defrost cycle in response to a defrost enable signal; the apparatus driving an air moving assembly moving air over the evaporator, said apparatus comprising:

a motor including a rotatable assembly in driving relation to the air moving assembly;

an energizing circuit selectively energizing the motor to maintain a substantially constant air flow rate over the evaporator;

a sensing circuit generating a speed/torque signal representative of a speed or a torque of the motor; and a defrost initiating circuit responsive to the speed/torque signal and generating the defrost enable signal when the speed/torque signal indicates a change in the motor speed or a change in the motor torque whereby the defrost cycle is initiated in response to degradation of the refrigeration cycle as indicated by frost or ice on the evaporator which reduces air flow through the evaporator and increases static pressure of the air flow.

18. The apparatus of claim 17 comprising a timer for timing a period of time after each defrost cycle and a memory, responsive to the timer, for storing a signal corresponding to the speed/torque signal at the end of the period of time, and wherein the defrost initiating circuit generates the defrost enable signal when the speed or the torque of the motor is greater than the speed or the torque corresponding to the signal stored in the memory.

19. The apparatus of claim 18 comprising a defrost cycle sensing circuit generating a defrost cycle signal provided to the control circuit when the speed/torque signal indicates a change in the motor speed or torque representing an defrost cycle; and wherein the motor control circuit generates the defrost signal when a difference between the speed and the reference speed or the difference between the torque and the reference torque is greater than a reference amount.

20. The apparatus of claim 17 wherein the motor control circuit generates the defrost signal when a difference between the speed and a reference speed or the difference between the torque and a reference torque is greater than a reference amount.

21. The apparatus of claim 17 wherein the energizing circuit includes a circuit controlling the speed/torque of the motor to maintain a constant air flow rate over the evaporator.

22. The apparatus of claim 17 wherein the energizing circuit includes a circuit controlling the speed/torque of the motor to maintain a substantially constant speed or torque of the motor.

23. The apparatus of claim 17 wherein the control circuit deenergizes the motor for a first period of time in response to the defrost cycle signal whereby the motor does not rotate the air moving assembly during the defrost cycle.

24. The apparatus of claim 23 wherein the control circuit energizes the motor at a first speed or torque for a second period of time following the first period of time and wherein the control circuit energizes the motor at a second speed or torque different than the first speed or torque following the second period of time.

25. A method of operating a refrigeration system including a compressor for compressing a working fluid evaporated in an evaporator and condensed in a condenser, said method comprising the steps of:

driving an air moving assembly with a motor to move air over the evaporator at a substantially constant air flow rate to cool a compartment;

sensing a speed/torque of the motor; and initiating a defrost cycle in response to the sensed speed/torque of the motor when the motor speed changes or when the motor torque changes whereby the defrost cycle is initiated in response to degradation of the refrigeration cycle as indicated by frost or ice on the evaporator which reduces air flow through the evaporator and increase static pressure of the air flow.

26. The method of claim 25 wherein said driving including driving the air moving assembly to maintain a substantially constant air flow rate over the evaporator.

27. The method of claim 25 wherein said driving including energizing the motor to maintain a substantially constant speed or torque of the motor.

28. The method of claim 25 further comprising the step of deenergizing the motor for a first period of time in response to a defrost cycle whereby the motor does not rotate the air moving assembly during the defrost cycle.

29. The method of claim 28 further comprising the step of energizing the motor at a first speed or torque for a second period of time following the first period of time and energizing the motor at a second speed or torque different than the first speed or torque following the second period of time.

30. An apparatus for use with a refrigeration system including:

a compressor for compressing a working fluid evaporated in an evaporator and condensed in a condenser; and a control circuit for initiating operation of a refrigeration cycle and for initiating a defrost cycle;

the apparatus driving an air moving assembly moving air over the evaporator, said apparatus comprising:

a motor including a rotatable assembly in driving relation to the air moving assembly;

an energizing circuit selectively energizing the motor in response to the control circuit to maintain a substantially constant air flow rate over the evaporator;

a sensing circuit generating a speed/torque signal representative of a speed or a torque of the motor;

a defrost cycle sensing circuit responsive to the speed/torque signal and generating a defrost cycle signal provided to the control circuit when the speed/torque signal indicates a change in the motor speed or torque representing an defrost cycle; and wherein the control circuit deenergizes the motor for a first period of time in response to the defrost cycle signal whereby the motor does not rotate the air moving assembly during the defrost cycle.

31. An apparatus for use with a refrigeration system including:

a compressor for compressing a working fluid evaporated in an evaporator and condensed in a condenser; and a control circuit for initiating operation of a refrigeration cycle and for initiating a defrost cycle in response to a defrost enable signal;

the apparatus driving an air moving assembly moving air over the evaporator, said apparatus comprising:

a motor including a rotatable assembly in driving relation to the air moving assembly;

an energizing circuit selectively energizing the motor in response to the control circuit;

a sensing circuit generating a speed/torque signal representative of a speed or a torque of the motor; and a defrost initiating circuit generating the defrost enable signal when the speed/torque signal indicates a change in the motor speed/torque or a change in the motor torque whereby the defrost cycle is initiated in response to degradation of the refrigeration cycle as indicated by frost or ice on the evaporator which reduces air flow through the evaporator and increases static pressure of the air flow; and wherein the control circuit energizes the motor at a first speed or torque for a second period of time following the first period of time and wherein the control circuit energizes the motor at a second speed or torque different than the first speed or torque following the second period of time.

32. An apparatus for use with a refrigeration system including:

a compressor for compressing a working fluid evaporated in an evaporator and condensed in a condenser; and a control circuit for initiating operation of a refrigeration cycle and for initiating a defrost cycle in response to a defrost enable signal;

the apparatus driving an air moving assembly moving air over the evaporator, said apparatus comprising:

a motor including a rotatable assembly in driving relation to the air moving assembly;

an energizing circuit selectively energizing the motor in response to the control circuit to maintain a substantially constant air flow rate over the evaporator;

a sensing circuit generating a speed/torque signal representative of a speed or a torque of the motor; and a defrost initiating circuit responsive to the speed torque signal and generating the defrost enable signal when the speed/torque signal indicates that the air flow rate is less than a reference air flow rate whereby the defrost cycle is initiated in response to degradation of the refrigeration cycle as indicated by frost or ice on the evaporator which reduces air flow through the evaporator and increases static pressure of the air flow.

33. An apparatus for use with a refrigeration system including:

a compressor for compressing a working fluid evaporated in an evaporator and condensed in a condenser; and a control circuit for initiating operation of a refrigeration cycle and for defrosting the evaporator during a defrost cycle and for terminating the defrost cycle in response to a defrost disable signal;

the apparatus driving an air moving assembly moving air over the evaporator, said apparatus comprising:

a motor including a rotatable assembly in driving relation to the air moving assembly;

an energizing circuit selectively energizing the motor in response to the control circuit;

a sensing circuit generating a speed/torque signal representative of a speed or a torque of the motor; and a defrost terminating circuit responsive to the speed/torque signal and generating the defrost disable signal when the speed/torque signal indicates a change during the defrost cycle in the motor speed/torque or a change during the defrost cycle in the motor torque whereby the defrost cycle is terminated in response to improvement of the refrigeration cycle as indicated by a reduction of frost or ice on the evaporator which increases air flow through the evaporator and decreases static pressure of the air flow.

34. An apparatus for use with a refrigeration system including:

a compartment to be refrigerated;

a temperature sensor for sensing the temperature in the compartment;

a compressor responsive to the temperature sensor for compressing a working fluid evaporated in an evaporator for cooling the compartment and condensed in a condenser remote from the compartment; and a defrosting circuit for defrosting the evaporator during a defrost cycle and for terminating the defrost cycle in response to a defrost disable signal; the apparatus driving an air moving assembly moving air over the evaporator, said apparatus comprising:

a motor including a rotatable assembly in driving relation to the air moving assembly;

an energizing circuit selectively energizing the motor;

a sensing circuit generating a speed/torque signal representative of a speed or a torque of the motor; and a defrost terminating circuit responsive to the speed/torque signal and generating the defrost disable signal when the speed/torque signal indicates a change during the defrost cycle in the motor speed or a change during the defrost cycle in the motor torque whereby the defrost cycle is terminated in response to improvement of the refrigeration cycle as indicated by a reduction of frost or ice on the evaporator which increases air flow through the evaporator and decreases static pressure of the air flow.

35. A method of operating a refrigeration system including a compressor for compressing a working fluid evaporated in an evaporator and condensed in a condenser, said method comprising the steps of:

driving an air moving assembly with a motor to move air over the evaporator to cool a compartment;

sensing a speed/torque of the motor; and terminating a defrost cycle in response to the sensed speed/torque of the motor when the motor speed changes during the defrost cycle or when the motor torque changes during the defrost cycle whereby the defrost cycle is terminated in response to improvement of the refrigeration cycle as indicated by a reduction of frost or ice on the evaporator which increases air flow through the evaporator and decreases static pressure of the air flow.

* * * * *